US006504898B1

(12) United States Patent
Kotler et al.

(10) Patent No.: US 6,504,898 B1
(45) Date of Patent: Jan. 7, 2003

(54) PRODUCT IRRADIATOR FOR OPTIMIZING DOSE UNIFORMITY IN PRODUCTS

(75) Inventors: Jiri Kotler, Nepean (CA); Joseph Borsa, Stittsville (CA)

(73) Assignee: MDS (Canada) Inc., Kanata (CA)

( * ) Notice: Subject to any disclaimer, the term of this patent is extended or adjusted under 35 U.S.C. 154(b) by 0 days.

(21) Appl. No.: 09/550,923

(22) Filed: Apr. 17, 2000

(51) Int. Cl.[7] ..... G21K 5/00
(52) U.S. Cl. ..... 378/64; 378/68
(58) Field of Search ..... 378/64, 68, 69, 378/208, 147, 150, 151, 95

(56) References Cited

U.S. PATENT DOCUMENTS

| | | | | |
|---|---|---|---|---|
| 4,029,967 A | | 6/1977 | Tetzlaff | 250/492 |
| 4,066,907 A | | 1/1978 | Tetzlaff | 250/453 |
| 4,419,764 A | | 12/1983 | Kinanen | 378/153 |
| 4,484,341 A | | 11/1984 | Luniewski | 378/69 |
| 4,561,358 A | | 12/1985 | Burgess | 104/89 |
| 4,652,763 A | | 3/1987 | Nablo | 250/492 |
| 4,845,732 A | | 7/1989 | Michel | 378/119 |
| 4,983,849 A | | 1/1991 | Thompson et al. | 250/492 |
| 5,001,352 A | | 3/1991 | Tetzlaff | 250/453.1 |
| 5,396,074 A | | 3/1995 | Peck et al. | 250/453.11 |
| 5,400,382 A | | 3/1995 | Welt et al. | 378/69 |
| 5,401,973 A | | 3/1995 | McKeown et al. | 250/492.3 |
| 5,434,420 A | | 7/1995 | McKeown et al. | 250/396 |
| 5,461,656 A | | 10/1995 | Golovanivsky et al. | 378/66 |
| 5,554,856 A | | 9/1996 | Bidnyy et al. | 250/455.11 |
| 5,557,109 A | | 9/1996 | Bidnyy et al. | 250/455.11 |
| 5,590,602 A | | 1/1997 | Peck et al. | 104/88.01 |
| 5,636,257 A | * | 6/1997 | Perilleux | 378/64 |
| 5,838,760 A | | 11/1998 | Moses | 378/119 |
| 5,945,684 A | | 8/1999 | Lam et al. | 250/492.3 |
| 5,994,706 A | | 11/1999 | Allen et al. | 250/454.11 |
| 6,110,318 A | | 8/2000 | Goodman | 156/272.2 |

FOREIGN PATENT DOCUMENTS

EP 0 223 432 5/1987

OTHER PUBLICATIONS

PCT Search Report, PCT/CA 01/00496, Nov. 22, 2001.
Patent Abstracts of Japan, Electron Beam Irradiation Method and Its Device, Application No. 10064816, application date Feb. 27, 1998.
Patent Abstracts of Japan, Radiation Generator, Application No. 09238616, application date Sep. 3, 1997.
Patent Abstracts of Japan, Method and Apparatus for Measuring Concentration Distribution of Element, Application No. 61309130, Dec. 27, 1986.
Patent Abstracts of Japan, Target Device for Damping X–ray Generation, Application No. 63065018, Mar. 18, 1988.
Database WPI, Derwent Publications Ltd., XP–002182523.

* cited by examiner

*Primary Examiner*—David P. Porta
(74) *Attorney, Agent, or Firm*—Haynes and Boone, LLP

(57) ABSTRACT

An apparatus and method for irradiating a product or product stack with a relatively even radiation dose distribution (low dose uniformity ratio (DUR). The apparatus comprises a radiation source for producing radiation in the range of X-rays or greater, an adjustable collimator for producing a radiation beam of a desired geometry, a turn-table capable of receiving a product stack and a control system capable of adjusting the adjustable collimator to vary the geometry of the radiation beam as the product stack is rotated in the radiation beam. Also disclosed is the modulation of the radiation beam energy and power and varying the angular rotational velocity of the product stack in a radiation beam to achieve a low dose uniformity ratio in the product stack. The invention also discloses a radiation detection system integrated with a control system for automatic processing, and monitoring of product stacks for delivery of a precise radiation dose distribution and a relatively flat dose distribution in a product stack.

8 Claims, 20 Drawing Sheets

PRODUCT IRRADIATOR FOR OPTIMIZING DOSE UNIFORMITY IN PRODUCTS

The present invention relates to a method and apparatus for irradiating products to achieve a radiation dose distribution that satisfies specified dose uniformity criteria throughout the product.

BACKGROUND OF THE INVENTION

The treatment of products using radiation is well established as an effective method of treating materials such as medical devices or foodstuffs. Radiation processing of products typically involves loading products into totes and introducing a plurality of totes either on a continuous conveyer, or in bulk, into a radiation chamber. Within the chamber the product stacks pass by a radiation source until the desired radiation dosage is received by the product and the totes are removed from the chamber. As a plurality of products, typically within totes, are present in the chamber at a given time, the radiation processing parameters affect all of the product within the chamber at the same time.

One common problem in the radiation processing of products is that the effectiveness of radiation processing is sensitive to variations in product density and geometry, and product source geometry. If a radiation chamber is loaded with totes comprising products with a range of densities and geometries, certain products will tend to be over-exposed to the radiation, while others do not achieved the required dose, especially within the central regions of the product. To overcome this problem the radiation chamber is typically loaded with products according to a specified and validated configuration so that the processing of the products satisfies a specified dose uniformity criteria. However, this is not always possible as some product package configurations are not compatible with achieving a good dose uniformity when irradiation is carried out in the conventional manner.

Products of a large dimension, and high density suffer from a high dose uniformity ratio (DUR) across the product. A relatively even radiation dose distribution (small DUR) is desirable for all products, but especially so for the treatment of foods, such as red meats and poultry. In treatment of these products, an application of an effective radiation dose to reduce pathogens at the centre of the stack is often limited by associated undesirable sensory or other changes in the periphery of the product stack as a result of the higher radiation dose delivered to material in this region of the product. A similar situation may arise during the radiation serialization of medical disposable products, a majority of which may be made from plastic materials. In these cases, the maximum permissible radiation dose in a product may be limited by undesirable changes in the characteristics of the plastics, such as increased embrittlement of polypropylene or decoloration and smell development of polyvinyl chloride. In order to adequately and thoroughly treat product stacks of such products with radiation processing, a relatively even radiation dose distribution characterized by a low DUR must be delivered throughout the product stack.

Radiation processing of materials and products has most often been accomplished using electron beams, gamma radiation or X-rays. A major drawback to electron beam processing, is that the electron beam is only capable of penetrating relatively shallow depths (i.e. cm) into product, especially high density products such as food stuffs. This limitation reduces the effectiveness of electron beam processing of bulk or palletized materials of high density. Gamma radiation is more effective in penetrating products, especially those of a higher density or larger dimensions, compared with electron beam. Most gamma sources are based on radioactive nuclides such as colbat-60. Kock and Eisenhower (National Research Council of the National Academy of Sciences Publication #1273; 1965) discuss the merits of different types of radiation processing for the purposes of food treatment. The article suggest that photons are the preferred source for treating large product stacks because of the greater ability of photons to penetrate the product.

U.S. Pat. No. 4,845,732 discloses an apparatus and process for producing bremsstrahlung (X-rays) for a variety of industrial applications including irradiation of food or industrial products. An alternate device for the production of X-rays is disclosed in U.S. Pat. No. 5,461,656 which also discloses X-ray irradiation of a range of materials. U.S. Pat. No. 5,838,760 and U.S. Pat. No. 4,484,341 teach a method and apparatus for selectively irradiating materials such as foodstuffs with electrons or X-rays. None of these documents discloses an apparatus or methods to deliver a relatively even radiation dose distribution, especially in large product stacks of high density, so that a low DUR is achieved in treated products.

U.S. Pat. No. 4,561,358 discloses an apparatus for conveying articles within a tote (carrier) through an electron beam. The invention teaches of a carrier that is capable of reorienting its position as the carrier approaches the electron beam. An analogous system is disclosed in U.S. Pat. No. 5,396,074 wherein articles are transported past an electron beam on a process conveyor system. The conveyor system provides for re-orientation of the carrier so that a second side (opposite the first side) of the carrier is exposed to the radiation source. The carrier is further defined in U.S. Pat. No. 5,590, 706. A similar electron beam irradiation device is disclosed in U.S. Pat. No. 5,994,706. An apparatus to optimize the dosage of electron beam radiation within a product are given in U.S. Pat. No. 4,983,849. The apparatus includes placing cylindrical or plate dose attenuators between the radiation beam and product. The attenuators comprise a moving, perforated metal plate (or cylinder) scatter the radiation beam and reflect non-intersecting electrons thereby increasing dosage uniformity.

U.S. Pat. No. 5,554,856 discloses a radiation sterilizing conveyor for sterilizing biological products, food stuffs, or decontamination of clinical waste and microbiological products. Products are placed on a disk-shaped transporter and rotated so that the products are exposed to a field of accelerated electrons. A similar apparatus for electron beam serialization of biological products, foodstuffs, clinical waste and microbiological products is also disclosed in U.S. Pat. No. 5,557,109. Products are placed in a recess or pocket of a manipulator which is slid horizontally into a cavity until the products are aligned with a path of an electron beam housed within the serialization unit.

In the prior art systems described above, there are limitations in the ability to deliver a relatively flat dose distribution (low DUR) throughout a product or product stack since no method is provided to compensate for the different dose received by the exterior and interior portions of the product stack. This therefore results in the outer portions of a product to receive a much higher radiation dose than that received within the product stack.

U.S. Pat. No. 4,029,967 and U.S. Pat. No. 4,066,907 disclose an irradiation device for the uniform irradiation of goods by means of electro-magnetic radiation having a quantum energy larger than 5 KeV. Products to be irradiated (including medical articles, feedstuffs, and food) rotate on turntables and are partially shielded from a radiation source by shielding elements. There is no discussion of optimizing the geometry of the radiation beam relative to the product stack, or modifying the spacing of the shield elements in order to optimize the DUR within a product. As a result, products with different densities are still subject to a wide range of DUR as is the case with other prior art systems. U.S. Pat. No. 5,001,352, also discloses a similar apparatus comprising product stacks that rotate on turntables, positioned around a centrally disposed radiation source, and shielding elements that reduce lateral radiation emitting from the source. A shielding element comprising a plurality of pipes that are fluid filled thereby permitting flexibility in the form of the shielding element is also discussed. However, there is no guidance as to how this or the other shielding elements are to be positioned in order to attenuate the radiation beam relative to the product stack in order to optimize the DUR within the product. Nor is there any discussion of any real-time adjustment of shielding elements to optimize the dose distribution received by a product that accounts for alterations in product densities.

A major limitation with the prior art irradiation systems is that it is difficult to obtain a relatively even radiation dose distribution (low DUR) throughout a product or product stack. For example, in systems which irradiate products from only one side, the material irradiated at the periphery of the product and closest to the irradiation source receives a high radiation dose relative to the product located at the center regions of the product stack, and further away from the radiation source resulting in a high DUR. Even with systems that irradiate products from multiple sides, the material irradiated at the periphery of the product typically receives a higher dose of radiation than the material located at the centre of the product since the radiation method is not optimized for the product stacks. Consequently, the product receives an uneven dose of radiation, characterized by a high DUR. Thus, prior art systems are limited in their ability to deliver a relatively flat dose distribution (low DUR) throughout a product or product stack. These limitations are more pronounced in larger products, with higher densities.

It is an object of the current invention to overcome drawbacks in the prior art.

The above object is met by the combinations of features of the main claims, the sub-claims disclose further advantageous embodiments of the invention.

SUMMARY OF THE INVENTION

The present invention relates to a method and apparatus for irradiating products to achieve a radiation dose distribution that satisfies specified dose uniformity criteria throughout the product.

According to the present invention there is provided a product irradiator comprising: a radiation source, an adjustable collimator, a turntable; and a control system. The radiation source may be selected from the group consisting of gamma, X-ray and electron beam radiation. Preferably, the radiation source is an X-ray radiation source comprising an electron accelerator for producing high energy electrons, a scanning horn for directing the high energy electrons and a converter for converting the high energy electrons into X-rays.

The present invention is also directed to the product irradiator as defined above which further comprises a detection system. The detection system measures at least one of the following parameters: transmitted radiation, instantaneous angular rotation velocity of the turntable, angular orientation of the turntable, power of the radiation beam, energy of the radiation beam, collimator aperture, width of the radiation beam, position of an auxiliary shield, offset of the radiation beam axis from axis of rotation of the product on the turntable, distance of the turntable from collimator, and distance of collimator from the source. Preferably, the detection system is operatively linked with said control system.

The present invention also pertains to a method of radiation processing a product comprising:

i) determine length, width, height and density of a product stack comprising the product;

ii) determining the width of a collimated radiation beam required to produce a low Dose Uniformity Ratio within the product;

iii) adjusting a collimator aperture to obtain the width determined in step ii); and iv) rotating the product stack within the collimated radiation beam for a period of time sufficient to achieve a minimum required radiation dose within the product.

This method also pertains to the step of adjusting (step iii), wherein an angular velocity of the turntable may be adjusted. Furthermore, within the step of adjusting, the collimated radiation beam is collimated X-ray beam produced from high energy electrons generated by an electron accelerator, and power of the high energy electrons may be adjusted.

This invention also pertains to the method as defined above wherein during or following the step of rotating, is a step (step vi) of detecting X-rays transmitted through the product. Furthermore, during or following the step of detecting (step vi), is a step (step vii) of processing information obtained in the detecting step by a control system and altering, if required, of any of the following parameters: collimator aperture, distance between the turntable and collimator, turntable offset, position of auxiliary shield, angular velocity of the turntable, power of the high energy electrons.

The present invention also pertains to the use of an apparatus comprising a radiation source for producing radiation energy selected from the group consisting of x-ray, e-beam, and radioisotope, an adjustable collimator capable of attenuating first portion of the radiation while permitting passage of a second portion of the radiation, the second portion of radiation shaped by the adjustable collimator into a radiation beam, the radiation beam traversing a turntable capable of receiving a product stack, and a control system capable of modulating the adjustable collimator or any one or all irradiation system parameters as the product stack rotates on the turn-table, for delivery of a radiation dose producing a low dose uniformity ratio (DUR) within the product stack.

The present invention further pertains to a method of irradiating a product stack with a low dose uniformity ratio comprising, rotating a product stack in an X-ray radiation beam of width less than or equal to the diameter of the product stack and modulating the width of the radiation beam relative to the rotating product stack. Modulation of the width of the radiation beam may be effected by adjusting the adjustable collimator, the distance between the product stack and collimator, or the distance between the source and collimator, position of an auxiliary shield, or a combination thereof, as the product stack rotates in the radiation beam.

The present invention is directed to a product irradiator comprising:

i) an X-ray radiation source essentially consisting of an electron accelerator for producing high energy electrons, a scanning horn for directing the high energy electrons towards a converter, the converter for converting said high energy electrons into X-rays to produce an X-ray beam, the X-ray beam directed towards a product requiring irradiation;

ii) an adjustable collimator for shaping the X-ray beam;

iii) a turntable upon which the product is placed; and iv) a control system in operative communication with the electron accelerator, the adjustable collimator and the turntable.

This invention also pertains to the product irradiator just defined further comprising a detection system in operative association with the control system. Furthermore, the turntable of the product irradiator may be movable towards or away from the adjustable collimator, or the turntable may be movable laterally, so that an axis of rotation of the product on the turntable is offset from the X-ray beam axis. The product irradiator may also comprising an auxiliary shield.

The present invention also pertains to the product as defined above, wherein the detection system measures at least one of the following parameters: transmitted X-ray radiation, instantaneous angular velocity of the turntable, angular orientation of the turntable, power of the high energy electrons, width of high energy electron beam, energy of the X-ray beam, aperture of the adjustable collimator, position of the auxiliary shield, offset of the radiation beam axis from axis of rotation of the turntable, distance of the turntable from collimator, and distance of the collimator from the radiation source.

This summary of the invention does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings wherein;

FIGS. 1(*a*) and 1(*c*) illustrate a two dimensional side view of a rectangular product of uniform density irradiated from a single side by a uniform radiation beam. FIGS. 1(*b*) and (*d*) depicts the radiation dose delivered to the product irradiated according to FIGS. 1 (*a*) and (*c*), respectively. FIG. 1(*e*) illustrates a two dimensional view of a rectangular product of uniform density irradiated from opposite sides by a uniform radiation beam. FIG. 1(*f*) depicts the radiation dose delivered in the product irradiated as in FIG. 1(*e*); "▲" denotes the dose distribution curve received along the right hand side of the product stack; "■" denotes the dose distribution curve received along the left hand side of the product stack; "◆" denotes the sum of the dose within the product.

FIG. 2(*a*) illustrates a two dimensional view of a cylindrical product irradiated with a radiation beam of width greater than or equal to the diameter of the product. FIG. 2(*b*) illustrates a typical radiation dose delivered in the cylindrical product irradiated as in FIG. 2(*a*) as a function of position along the center line. FIG. 2(*c*) illustrates a two dimensional view of a cylindrical product irradiated with a narrow radiation beam passing through the centre axis of the product. $R_1$and $R_2$ denote points of volume elements in the product which are offset from the centre of the product. Rotational axis of the product cylinder is parallel to the vertical center line of the beam aperture. FIG. 2(*d*) represents the radiation dose delivered in the product, irradiated as in FIG. 2(*c* ) as a function of position along line X–X'. FIG. 2(*e*) illustrates a two dimensional view of a cylindrical product in a radiation beam of optimal width for the diameter and density of the product. FIG. 2(*f*) represents the radiation dose delivered in the product, irradiated as in FIG. 2(*e*) as a function of position along line X–X', displaying a relatively even radiation dose distribution curve yielding a low DUR in the product along diameter X–X'.

FIG. 3(*a*) shows a top view of an irradiation apparatus depicting a shallow collimator profile. FIG. 3(*b*) shows a top view of an irradiation apparatus depicting a tunnel collimator. FIG. 3(*c*) shows a top view of the apparatus with an offset collimator directing the radiation beam preferentially to one side of the product, in this embodiment the radiation beam axis is offset from the axis of rotation of the turntable. FIG. 3(*d*) shows a top view of the apparatus with a movable auxiliary shield placed in the path of the radiation beam. In this figure, the wedge is positioned in approximate alignment with the collimator.

FIG. 10(*a*) shows the dose profile for a product with a density of 0.2 g./cm$^3$, for three beam widths, 10, 50 and 120 cm. FIG. 10(*b*) shows the dose profile for a product with a density of 0.8 g./cm$^3$, for three beam widths, 10, 50 and 120 cm.

FIG. 11(*a*), shows the depth profile for a 60 cm diameter product. FIG. 11(*b*) shows the depth profile for a 80 cm diameter product. FIG. 11(*c*) shows a summary of results over a range of collimator aperture widths that produce an optimized DUR, for products of increasing diameter.

FIG. 12(*a* ) shows 8 stepped collimator aperture widths over a 90° rotation of the product stack, as well as the idealized calculated aperture width to optimize DUR within a rotating, rectangular product (using a 1mm Ta convertor, see example 2 for details). Starting with the 100 cm long side facing the beam, these adjustments are repeated for the remaining 2702 of product rotation. FIG. 12(*b*) shows 26 stepped collimator aperture widths over a 90° rotation of the product stack, as well as the idealized calculated aperture width to optimize DUR within a rotating, rectangular product (using a 2.35 mm Ta convertor, see Example 3). These adjustment are repeated for the remaining 270° of product rotation. FIGS. 12(*c*) and 12(*d*) show stepped adjustments to the power of the radiation beam over a 90° rotation of the product stack. These adjustments in beam power are repeated over the remaining 270° of product rotation.

DESCRIPTION OF PREFERRED EMBODIMENT

The present invention relates to a method and apparatus for irradiating products to achieve a radiation dose distribution that satisfies specified dose uniformity criteria throughout the product.

The following description is of a preferred embodiment by way of example only and without limitation to the combination of features necessary for carrying the invention into effect.

Figure 4:
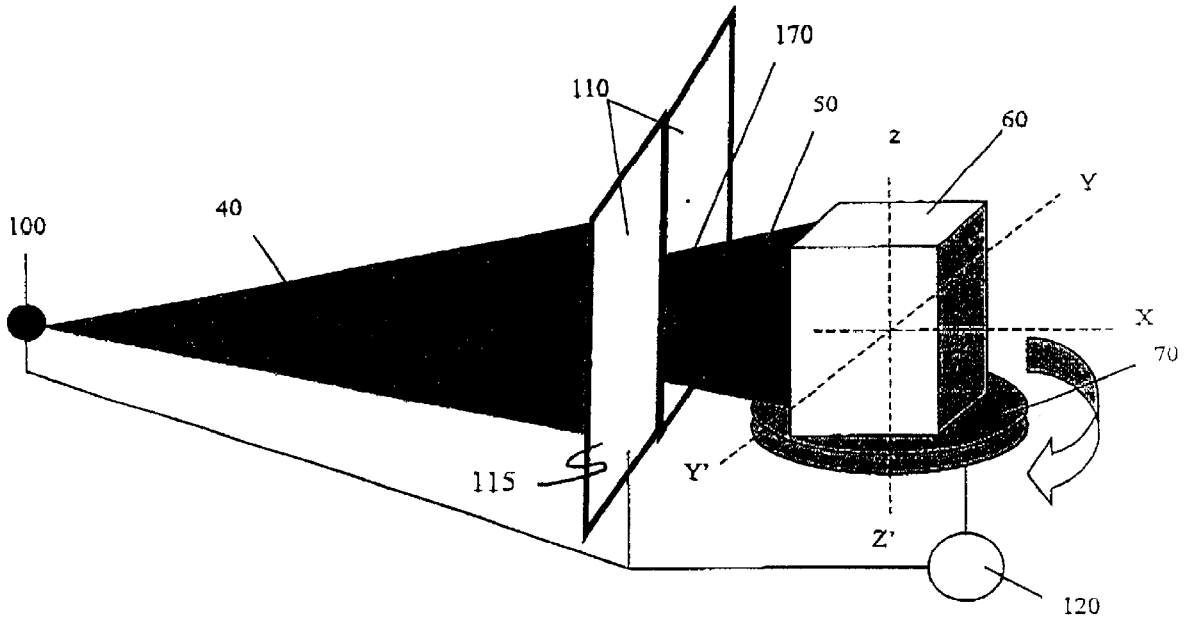
FIG. 4 depicts an aspect of an embodiment of the current invention showing the shaping of the radiation beam as it passes through a collimator, and a rotating product stack irradiated with the collimated radiation beam.
Figure 5:
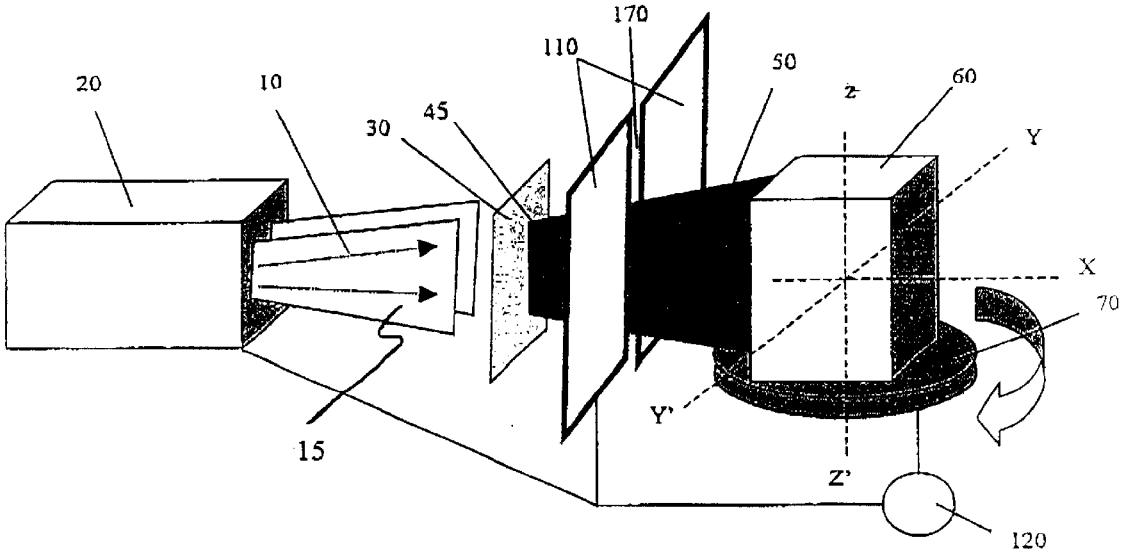
FIG. 5 depicts an aspect of the embodiment of the invention wherein an accelerator is employed to produce an X-ray beam for irradiation of a rotating product stack.
Figure 6:
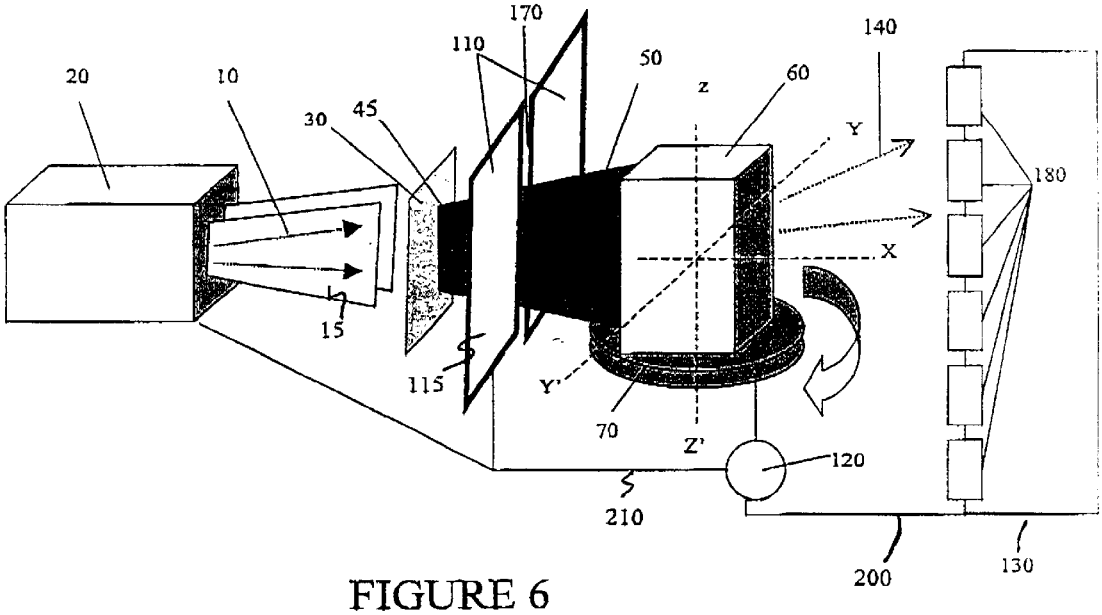
FIG. 6 illustrates an aspect of an embodiment of the invention wherein one or more radiation detector units integrated with a control system, is capable of controlling a variety of radiation processing parameters.

By "radiation processing" it is meant the exposure of a product, or a product stack (60) to a radiation beam (40: FIG. 4; or 45; FIG. 5) or a collimated radiation beam (50; FIGS. 4 to 6). The product must be within the radiation chamber (80), and the radiation source must be placed into position and unshielded as required to irradiate the product, for example as in the case of but not limited to a radioactive source (100; for example the radioactive source that is raised from a storage pool), or the radiation source must be in an active state, for example when using an electron-beam (15), or X-rays derived from an electron beam (e.g., 45; FIG. 5) in order to irradiate the product or product stack (60). It is to be understood that any product may be processed according to the present invention, for example, but not limited to, food products, medical or laboratory supplies, powdered goods, waste, for example biological wastes.

By the term "dose uniformity ratio" or "DUR" it is meant the ratio of the maximum radiation dose to the minimum radiation dose, typically measured in Grays (Gy) received within a product or product stack, and is expressed as follows:

$$DUR=Dose_{max}/Dose_{min}$$

$Dose_{max}$ (also referred to as $D_{max}$) is the maximum radiation dose received at some location within the product or product stack in a given treatment, and $Dose_{min}$ is the minimum radiation (also referred to as $D_{min}$) dose received at some location within the same product or product stack in a given treatment. A DUR of 2 indicates that the highest radiation dose received in a volume element located somewhere within the product stack is twice the lowest radiation dose delivered in a volume element located at a different position within the product or product stack. A DUR of about 1 indicates that a uniform dose distribution has been delivered throughout the product material. A "high DUR" is defined to mean a DUR greater than about 2. A "low DUR" is defined to mean a DUR of about 1to less than about 2. These are arbitrary categories. Conventional irradiation system are characterized as producing a high DUR of above 2 for low density products, and above 3 for products with densities greater than or equal to 0.8 g./cm$^3$.

By the term "accelerator" (20; FIG. 5) it is meant an apparatus or a source capable of providing high energy electrons preferably with energy and power measured in millions of electron volts (MeV) and in kilowatts (kW) respectively. The accelerator also includes associated auxiliary equipment, such as a RF generator, Klystron, power modulation apparatus, power supply, cooling system, and any other components as would be known to one skilled in the art to generate an electron beam.

By the term "scanning horn" it is meant any device designed to scan a beam of high energy electrons over a specified angular range. The dimensions may include a horizontal or a vertical plane of electrons. The scanning horn may comprise a magnet, for example, but not limited to a "bowtie" magnet, to produce a parallel beam of electrons emitting from the horn. Also, the "scanning horn" may be an integral part of the accelerator or it may be a separate part of the accelerator.

By the term "converter" (30; FIG. 5) it is meant a device or object designed to convert high energy electrons (10, 15) into X-rays (45; FIG. 5).

By the term "collimator" or "adjustable collimator" (110) it is meant a device that shapes a radiation beam (40, 45) into a desired geometry (50). Typically the shape of the radiation beam is adjusted in its width, however, other geometries may also be adjusted, for example, but not to be considered limiting, its height to both its height and width, as required. It is also contemplated that non-rectangular cross-sections of the beam are also possible. The collimator defines an aperture through which radiation passes. The collimator may have a shallow profile as depicted in FIG. 3(*a*), or may have an elongated profile as depicted in FIG. 3(*b* ). An elongated collimator, such as that shown in FIG. 3(*b*) helps focus the radiation beam by counter acting the penumbra. Adjustments to the aperture of the collimator shape the radiation beam into the desired geometry and dimension required to produce a DUR approaching 1 for a product stack with particular characteristics (such as geometry and density).

By the term "adjustable collimator" it is meant a collimator with an adjustable aperture that shapes the radiation beam into any desired geometry, for example, but not limited to adjusting the height, width, offset of the beam axis from the axis of rotation of the turntable, or a combination thereof, before or during radiation processing of a product or product stack. For example, an adjustable collimator may comprise a two or more radiation opaque shielding elements (for example, 115), that move horizontally thereby increasing or decreasing the aperture of the collimator as required. Shielding elements other than that shown in FIGS. 4 to 6 may also be used that adjust the aperture of the collimator. For example, which is not to be considered limiting, the shielding elements may comprise a plurality of overlapping plates each being radiation opaque, or partially radiation opaque, and capable of moving independently of each other. The overlapping plates may be moved as required to adjust the opening of aperture 170 (see Examples 2 and 3for results relating to optimizing DUR by adjusting aperture width of collimator). The shielding elements may also comprise, which again is not to be considered as limiting, a plurality of pipes (e.g. U.S. Pat. No. 5,001,352; which is incorporated herein by reference) each of which may be independently filled, or emptied, with a radiation opaque substance. The filling or emptying of the pipes adjusts the effective width of the collimator aperture as required.

By "auxiliary shield" it is meant a device that partially blocks the radiation beam and is placed within the radiation beam, between the converter and product stack (see 300, FIG. 3(*d*)). The auxiliary shield helps to further shape the radiation beam, regulate penumbra, and reduce the central dose of the radiation beam within the product stack. Preferably the auxiliary shield is movable along the axis of the radiation beam so that it may be variably positioned in the path of the radiation beam, between the converter and product stack.

By the term "detection system" (130) it is meant any device capable of detecting parameters of the product stack before, and during radiation processing. The detection system may comprise one or more detectors, generally indicated as 180 in FIG. 6, that measure a range of parameters, for example but not limited to, radiation not absorbed by the product. If measuring transmitted radiation, such detectors are placed behind the product to measure the amount of radiation transmitted through the product stack. However, detectors may also be placed in different locations around the product, or elsewhere so that other non-absorbed radiation is monitored. Other detectors may also be used to determine parameters before, or during radiation processing, including but not limited to those that measure the position of rotation of the turntable (angular orientation), instantaneous angular velocity of the turn table, collimator aperture, product density product weight, energy and power of the electron beam, and other parameters associated with the conveying system or geometry of the system arrangement.

Figure 7:
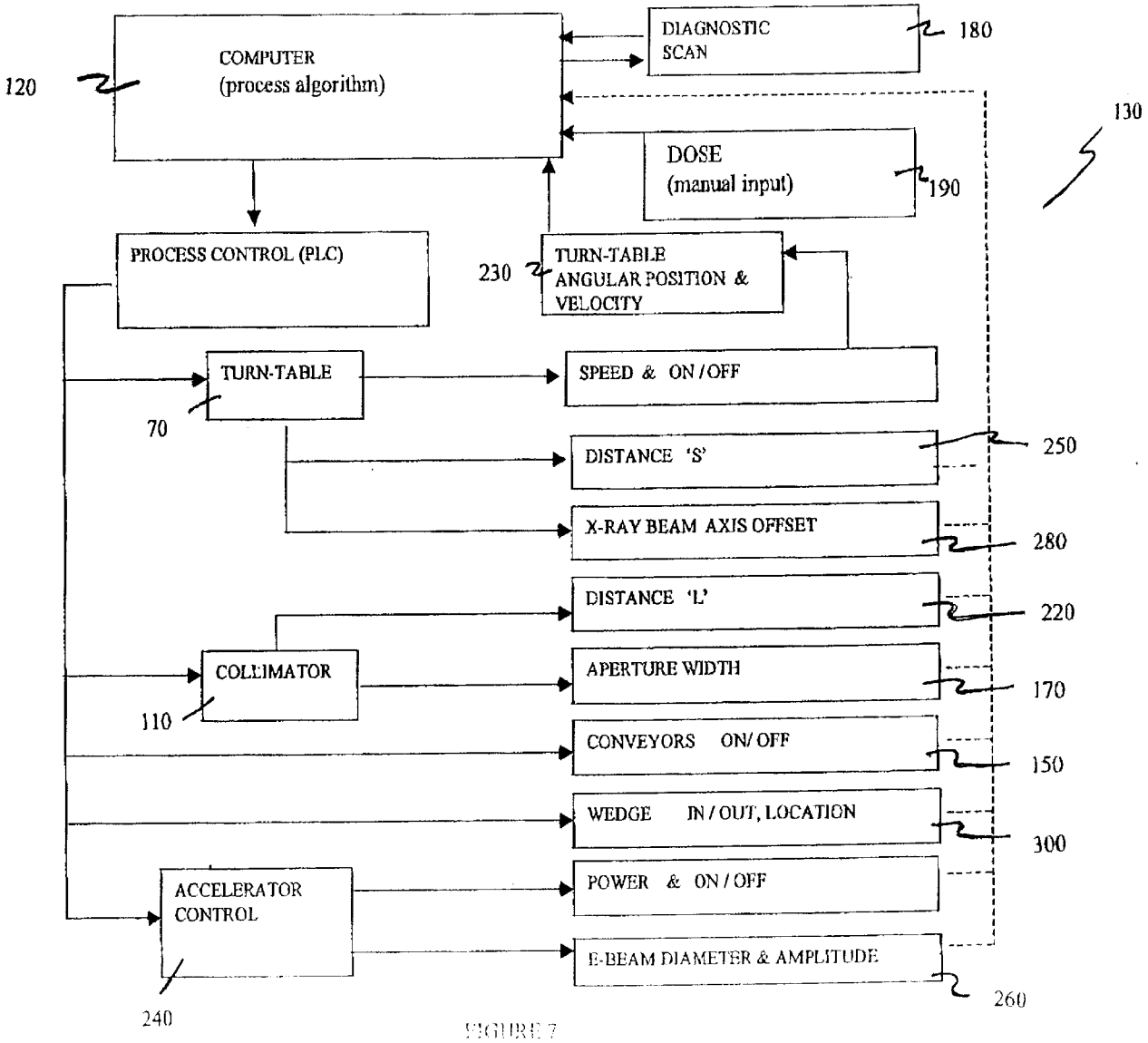
FIG. 7 depicts a schematic arrangement of the control system of the present invention.

A control system, generally indicated as 120 in FIG. 7, is used to receive the information obtained by the detector system (130) to either maintain the current system settings, or adjust one or more components of the irradiation system of the present invention as required (see FIG. 6). These adjustments may take place before, or during radiation processing of a product. Components that are monitored by the control system (120), and that may be adjusted in response to information gathered by the detector system (130) include, but are not limited to, the size of aperture (170, i.e. the beam geometry), power of the radiation beam (45), energy of the radiation beam (15, speed of rotation of the turntable (70), angular position (orientation) of turntable (230), instantaneous angular velocity of the turntable, distance of the collimator from the source ('L', FIG. 3(*a*), 220, FIG. 7), distance of the turntable from the collimator ('S', FIG. 3(*a*); 250, FIG. 7), and conveying the system (150). In this manner, the control system (120) uses parameters derived from characteristics obtained from a detector system (130) in order to optimize the radiation dose distribution delivered to the product stack (60). The control system includes, in addition to the detection system (130, hardware and software components (190) required to evaluate the information obtained by the detector system, and the interfacing (200, 210) between the computer system (190) and the detector system (interface 200), and the elements or the radiation system (interface 210).

Theory of Optimizing DUR Within a Product Stack

Figure 1:
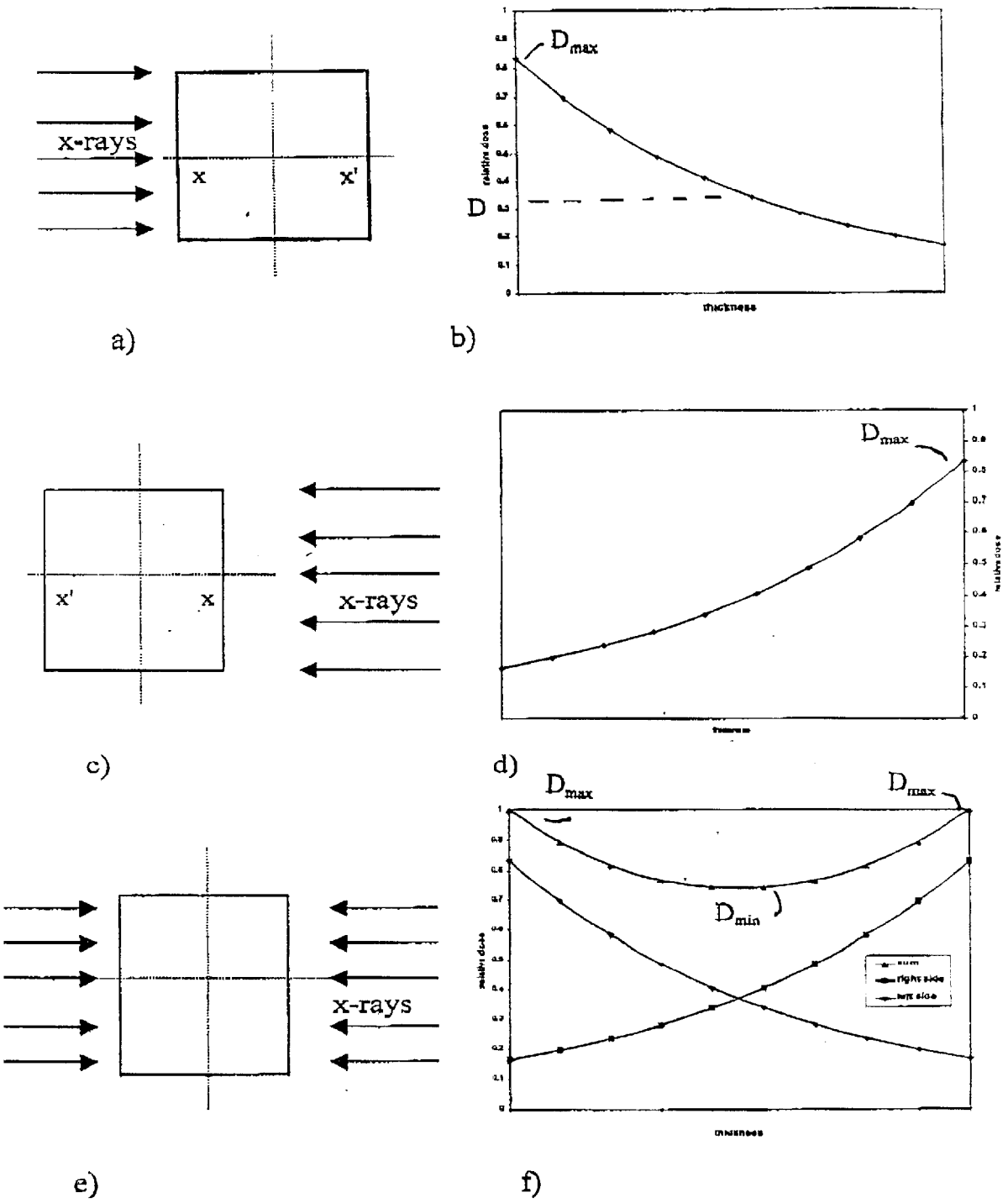
FIG. 1 depicts typical radiation dose distribution-depth curves for products irradiated from a single side or multiple sides as is currently done in the art.

FIG. 1, illustrates the radiation dose profiles within a product that has been exposed to irradiation from either one or two sides which are common within the art, for example, irradiation processes involving one side are disclosed in U.S. Pat. No. 4,484,341; U.S. Pat. No. 4,561,358; 5,554,856; or U.S. Pat. No. 5,557,109. Similarly, two-sided irradiation of product is described in, for example, U.S. Pat. No. 3,564, 2414; U.S. Pat. No. 4,151,419; U.S. Pat. No. 4,481,652 U.S. Pat. No. 4,852,138; or U.S. Pat. No. 5,400,382.

Shown in FIGS. 1(*a*) and (*c*) are two dimensional representations of the irradiation of a product stack from a single side with a uniform radiation beam. The radiation dose delivered through the depth of the product stack along line X–X' of FIGS. 1(*a*) and (*c*) is represented in FIGS. 1(*b*) and (*d*), respectively. The dose response curve decreases with distance from the product surface nearest the source to a minimum level ($D_{min}$) at the opposite side of the product stack, at position M. With one sided radiation processing the DUR ($D_{max}/D_{min}$) is much greater than 1. 'D' represents the minimum radiation dose required within the product for a desired specific effect, for example but not limited to, sterilization. A portion of the product has not reached the minimum required dose in FIG. 1(*d*) therefore a longer irradiation period is required for all of the product to reach at least the minimum required dose (D). This results in over exposure of the product on the side facing the radiation source and this is undesirable for the processing of many products that are modified as a result of exposure to excessively high doses of radiation.

Similar modelling for two sided irradiation of a product is presented in FIGS. 1(*e*) and (*f*). Under this radiation processing condition two sides of the product receive a high radiation dose, relative to the middle of the product stack at position M. Two sided irradiation still results in a relatively high DUR in the product stack, but the difference between $D_{max}$ and $D_{min}$ is reduced, and the DUR is improved when compared to one-sided irradiation.

Figure 2:
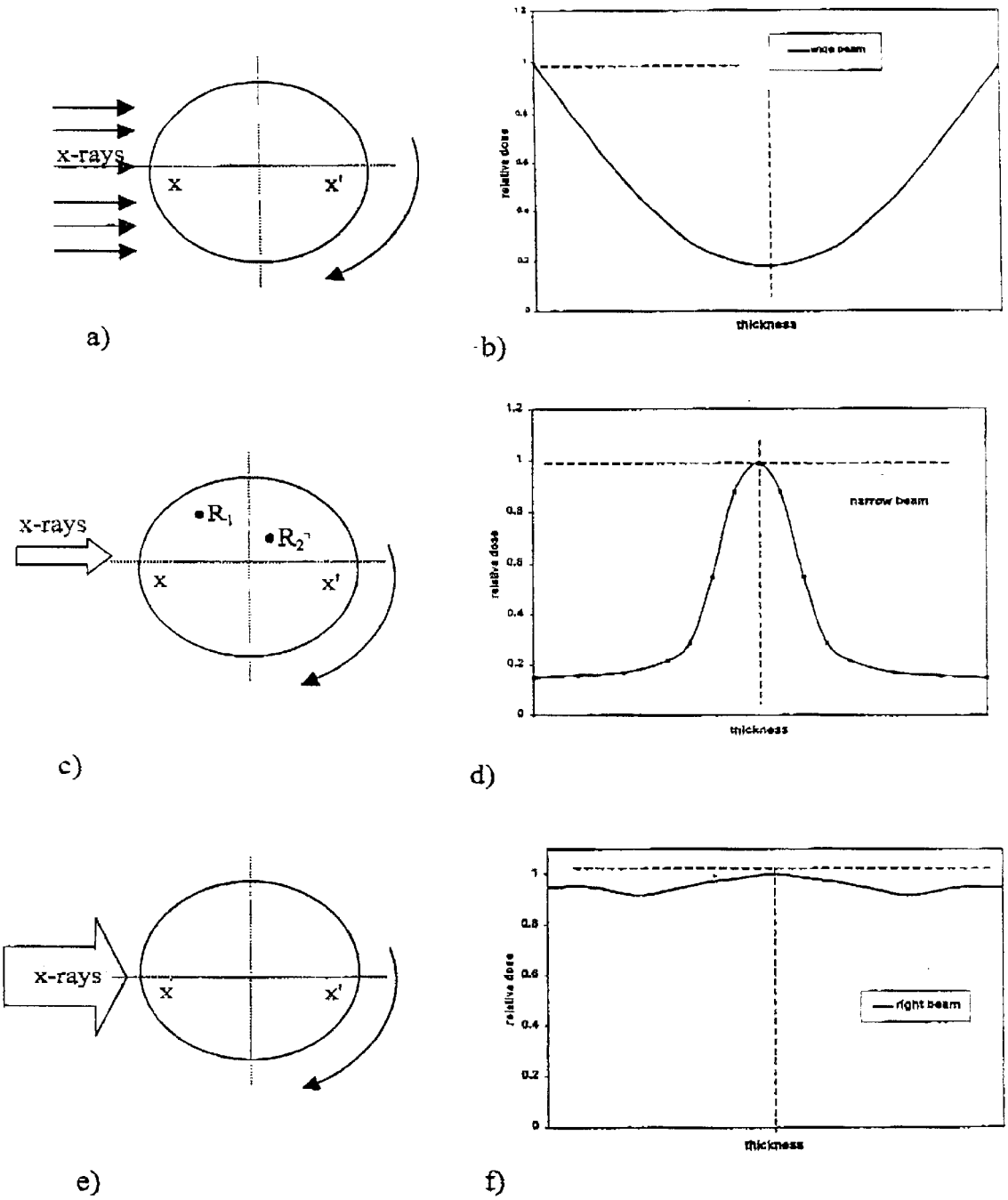
FIG. 2 depicts the radiation dose distribution-depth curves delivered in cylindrical products of uniform density which have undergone rotation in a radiation beam.
Figure 3A:
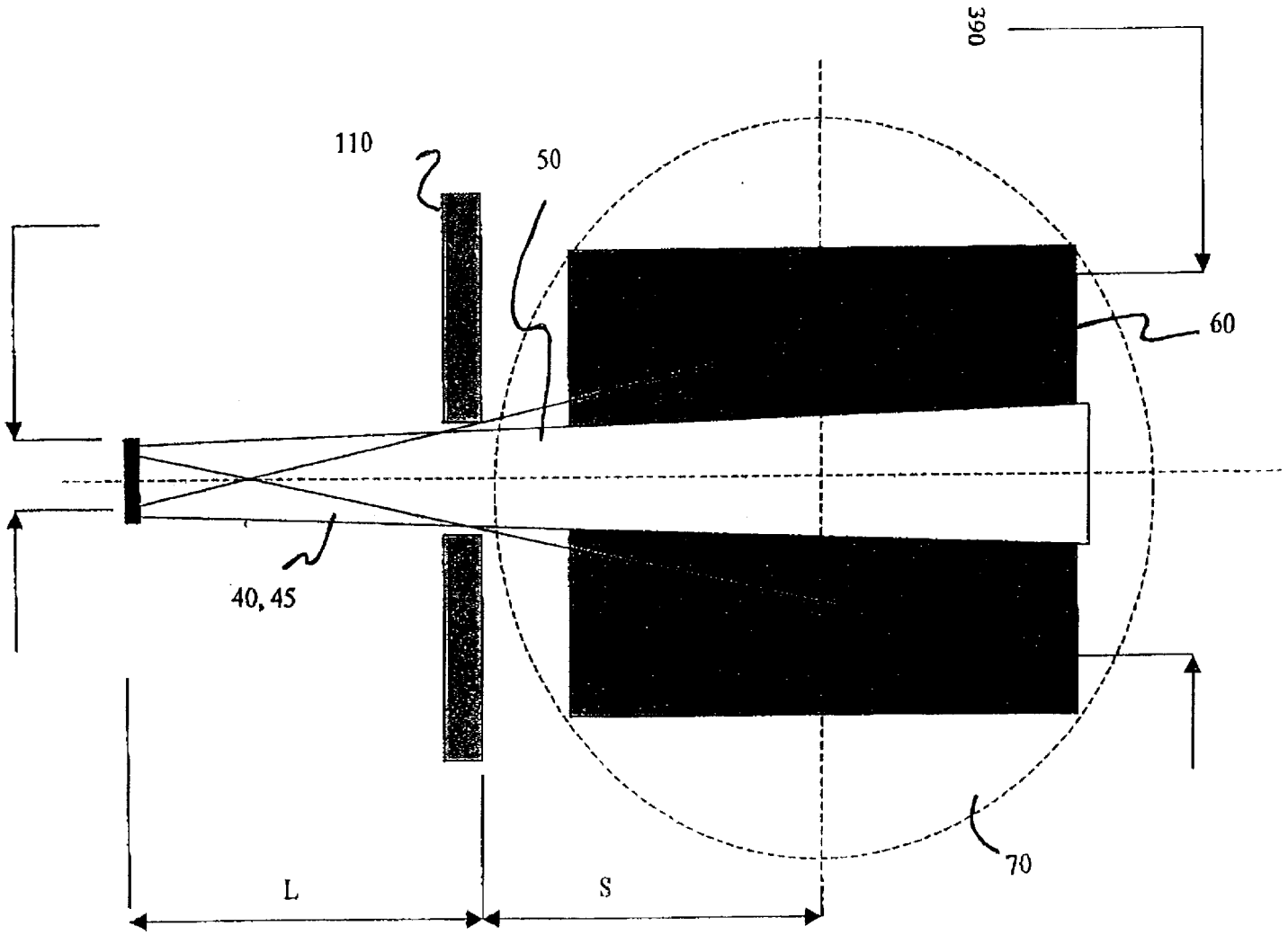
FIG. 3 shows several aspects of embodiments of the invention depicting the relationship between the radiation beam, aperture and product. Several of the parameters which must be considered for delivering a relatively even radiation dose distribution (low DUR) in a product or products stack are indicated (see disclosure for details).
Figure 3B:
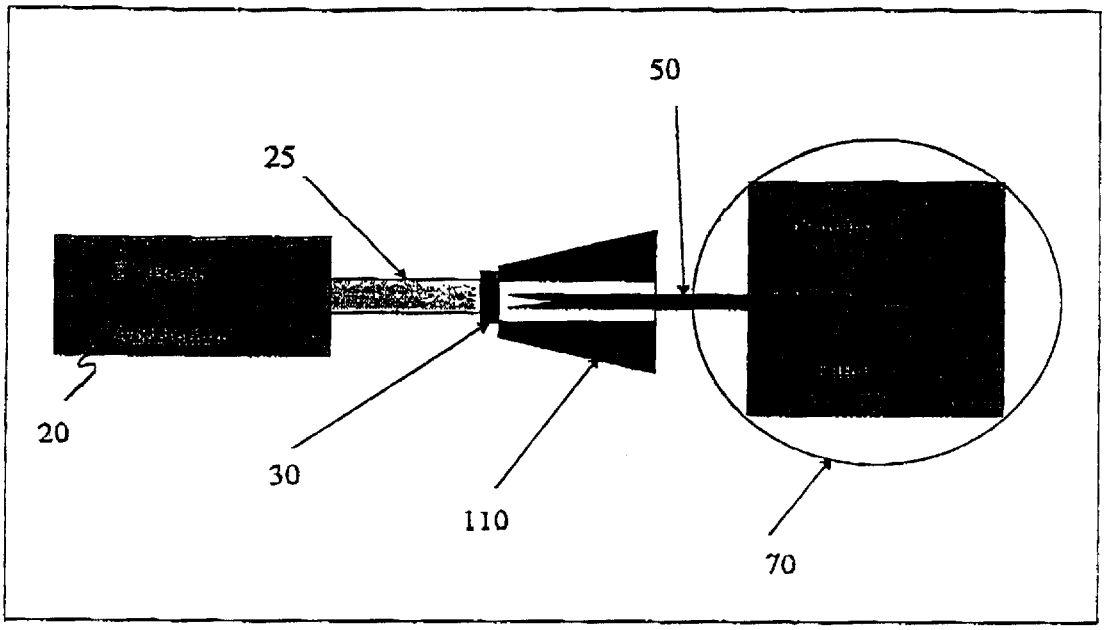
Figure 3C:
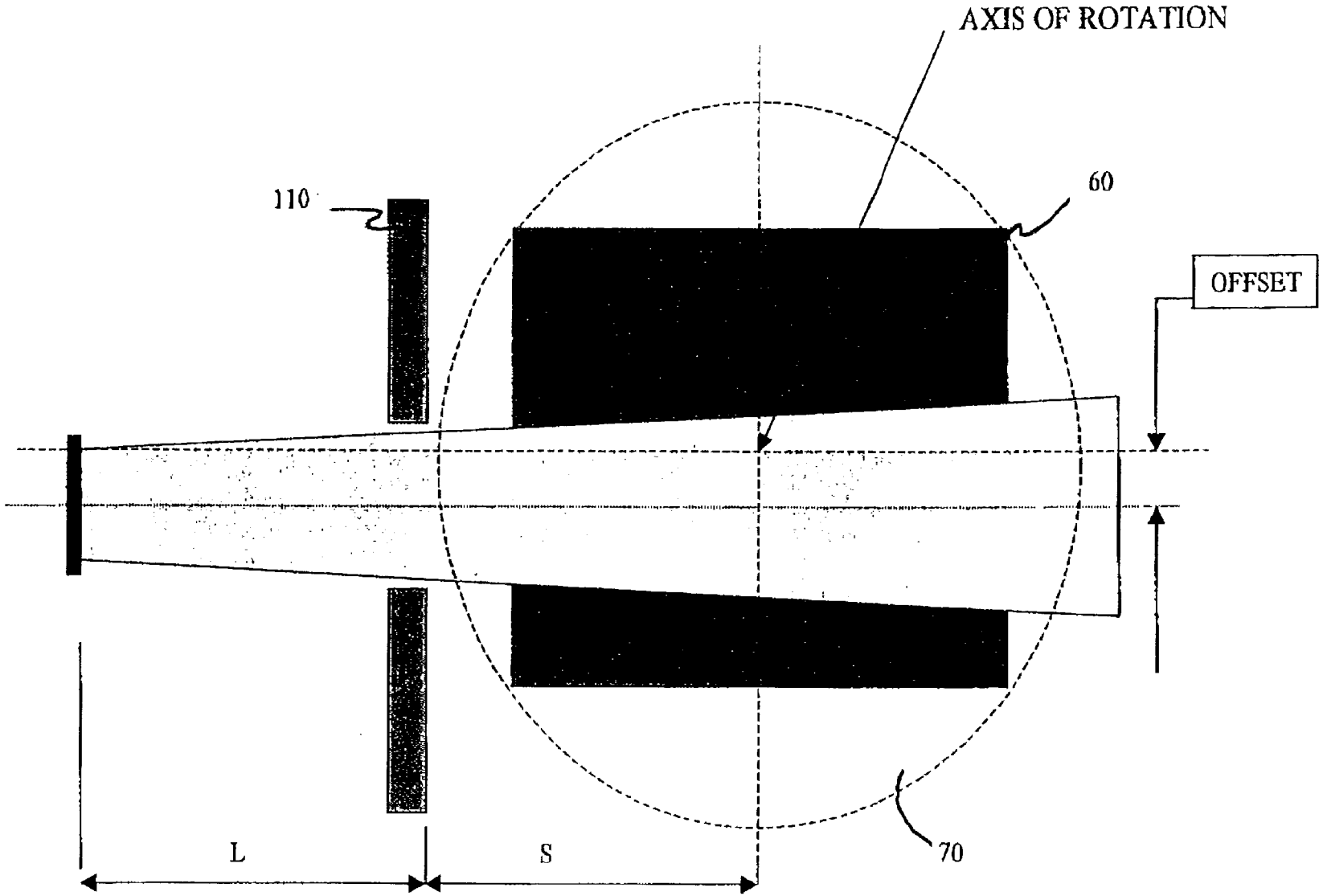
Figure 3D:
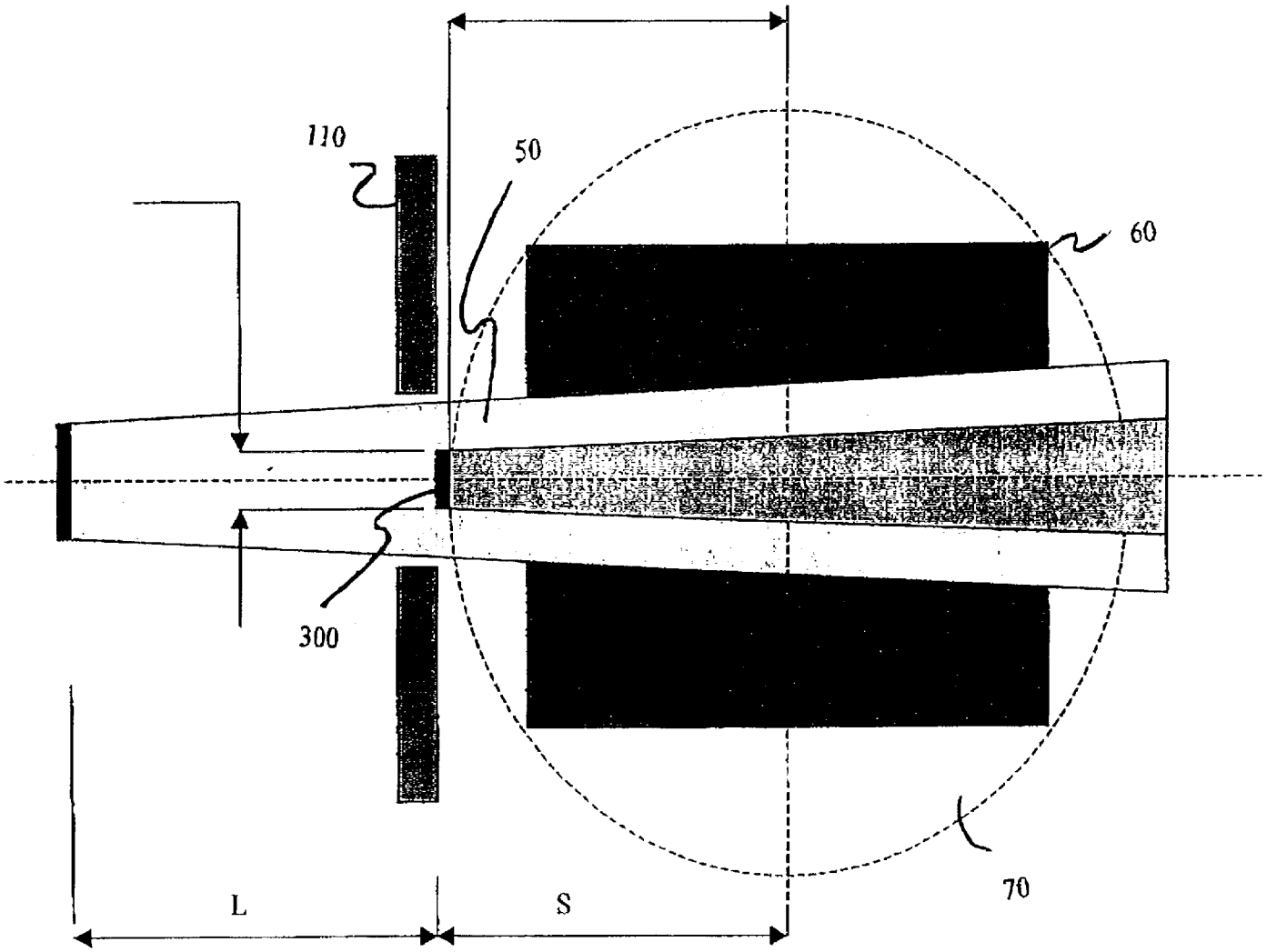

FIG. 2(*a*), illustrates a two dimensional view of the irradiation of a product stack rotating about its axis in a uniform radiation field where the width of the radiation beam is greater than or equal to the diameter of the product. The product stack for simplicity is depicted as having a circular cross section, however, rectangular product stacks, or irregularly shaped products may also be rotated to produce similar results as described below.

Shown in FIG. 2(*b*) is the corresponding radiation dose profile received by the product stack shown along line X–X'. Under these conditions, the radiation dose distribution delivered in the product stack along X–X' approximates the radiation dose distribution delivered to the product stack in two-sided radiation (also along X–X'; FIG. 1(*e*)) resulting in relatively high DUR.

If a rotated product stack is irradiated using a radiation beam that is much narrower than the diameter (or maximum width) of the product stack, and which passes through the centre of the product stack as shown in FIG. 2(*c*), then the radiation dose distribution curve along X–X' is relatively low at the periphery of the product stack and much greater at the center of the product stack (see FIG. 2(*d*)). In such a case, the centre of the product is always within the radiation beam, whereas volume elements such as those defined by points $R_1$ and $R_2$ (FIG. 2(*c*)) only spend a portion of time in the radiation beam. This fractional exposure time is a function of 'r' (FIG. 3(*a*) and beam width ('A', FIG. 3(*a*)). The beam width can be controlled in order to control fractional exposure time and hence dose within the produce. The fractional exposure time may also be controlled by offsetting the beam from the central axis of rotation of the product stack (see FIG. 3(*c*).

Both radiation dose distribution curves (FIGS. 2(*b*) and (*d*)) exhibit large differences between $D_{max}$ and $D_{min}$ and DUR of these product stacks is still much greater than 1. However, by using a radiation beam wider than the product stack, or a radiation beam much narrower than the product stack, the dose distribution profile within the product can be inverted. Therefore, an optimal radiation beam dimensions relative to a rotating product stack such as that shown in FIG. 2(*e*) can be determined, which is capable of irradiating a rotating product stack and producing a substantially uniform dose throughout the product stack with a DUR approaching 1 (FIG. 2(*f*)). It is also to be understood that by varying the diameter of the incident radiation beam, for example, by altering the width of the scanning pattern, that the penumbra (390) of the beam may be altered. Typically by increasing the beam width, the penumbra also increases (see FIG. 3(*a*)). Furthermore, by placing an auxiliary shield (300) between the converter and product, the primary beam intensity can also be adjusted (e.g. FIG. 3(*d*)).

Another method for altering the dose received within the product stack is to offset the position of the radiation beam axis with respect to the product axis of rotations (FIG. 3(*c*)). In this arrangement, a portion of the product is always out of the radiation beam as the product stack rotates, while the central region of the product receives a continual, or optionally reduced, radiation does.

The optimal beam dimension must also account for other factors involved during radiation processing, for example but not limited to, product density, the size of aperture (170, i.e. the beam geometry), power of the radiation beam (45), energy of the radiation beam, speed of rotation of the turntable (70), angular position (orientation) of turntable (230), instantaneous angular velocity of the turntable, distance of the collimator from the source ('L'; 220), and distance of the turntable from the collimator ('S'; 250; also see FIG. 7).

Irradiation Parameters Affecting DURs in Product Stacks

As indicated above, the ratio of the radiation beam width (A; FIG. 3) to the width (or diameter) of the product stack (r) is an important parameter for obtaining a low DUR within a product stack. As shown in FIG. 2(*d*), for product stacks of uniform density, the smaller the ratio of A/r, the higher the accumulated dose is at the centre of the stack relative to that at the periphery. Conversely, the larger the ratio of A/r, the accumulated dose is greater at the stack periphery (FIG. 2(*b*)). In the case of a cylindrical product stack, the optimum ratio of A/r, producing the lowest DUR within the product stack, can be constant (FIG. 2(*f*)). However, in the case of a rectangular product stack, such as is found in most pallet loads, the effective principal dimension is a function of its angular position (ϕ) with respect to the beam, since the width of the product changes as the product stack rotates. Therefore, to maintain an optimal DUR within the product stack, the ratio of A/r is adjusted as required. For example the A/r ratio may be determined for a product stack of known size and density, so that 'A' is set for an average 'r'. This determination may be made based on knowledge of the contents, density and geometry of the product and product stack (or tote), and this data entered into the system prior to radiation processing, or it may be determined from a diagnostic scan (see below; e.g. FIG. 6) of a product stack prior to radiation processing. It is also contemplated that the A/r ratio may be modulated dynamically as a rectangular product stack rotates in the radiation beam. The A/r ration may be adjusted by either modifying the aperture (170) of the collimator (170), by adjusting the diameter of the beam (i.e. adjusting beam width, and modulating penumbra), by moving shielding elements 115 appropriately, by placing an auxiliary shield (300) between the converter and product stack, by moving turntable 70 as required into and away from the source, by adjusting the aperture, offset, and modifying the turntable distance from the source, or by adjusting the distance, 'L', between the collimator (110) and source (100).

The geometry of the radiation beam (40, 45) produced from a source, for example, but not limited, to a Y-radiation (40) emitted by a radioactive source (e.g. 100; for example but not limited to C0-60), or accelerating high energy electrons (10, 15) interacting with a suitable converter (30) to produce X-rays (45), is determined by the relationship between the following parameters:

a) the width of the radiation beam, either Y, or X-ray (D; FIG. 3);

b) the distance (L) between the source (100) or converter (30) and the collimator (110);

c) the distance (S) between the collimator (110) and the product (60) center of rotation, d) the size of the aperture (W) in the collimator (110), and e) the position of an auxiliary shield (290).

These parameters determine divergence of the beam and the associated penumbra. Optimisation of these parameters relative to the size and density of a product stack reduces the DUR within the product stack.

Dynamically Adjusting 'A/r' and Associated Parameters During Processing

An initial adjustment of the ratio of beam width to the product stack width (A/r) for a product of a certain density is typically sufficient for a range of product densities and product stack configurations to obtain a sufficiently low DUR. However, in the case of irregular, or irregular rectangular product stack shapes, or product stack containing products with differing densities, modulation of the A/r ratio may be required to obtain a low dose uniformity within a product. Other parameters may also be adjusted optimize dose uniformity within the product stack. These parameters may include adjustment of the speed of rotation of the product stack, modifying the beam power, thereby modulating the rate of energy deposition within the product stack, or both. Modulation of beam power may be accomplished by any manner known in the art including but not limited to adjusting the beam power of the accelerator, or if desired, when using a radioactive isotope as a source, attenuating the radiation beam by reversibly placing partially radiation opaque shielding between the source and product stack. Minor adjustments to the intensity of the radiation beam may also include modulating the distance between the product and source.

Design of the converter (30) also may be used to adjust the effective energy level of an X-ray beam. As the thickness of the converter increases, lower energy X-rays attenuate within the converter, and only X-rays with high energy level of all, or of a portion of, the X-ray beam may be modified. For example, in the case where the electrons emitting from the scanning horn are not parallel, it may be desired that the upper and lower regions of the X-ray beam be of higher average energy since the beam travels through a greater depth within the product stack, compared to the beam intercepting the mid-region of the product stack (however, it is to be understood that parallel electrons may be produced from a scanning form using one or more magnets positioned at the end of the scanning horn to produce a parallel beam of electrons). Furthermore, these regions of the product stack experience less radiation backscatter due to the abrupt change in density at the top and bottom of the product stack. Therefore, a converter with a non-uniform thickness, wherein the thickness increases in its upper and lower portions, may be used to ensure higher energy X-rays are produced in the upper and lower regions from the converter. Modifications to converter thickness typically can not be performed in real time. However, different converters may be selected with different thickness profiles that correspond with different densities or sizes of products to be processed. Furthermore, the power of the beam may also be modulated as a function of vertical position within the product stack so that a higher power is provided at the upper and lower ends of the product stack.

Other methods may be employed to increase the effective dose received at the ends (upper and lower) of the product stack. Since the upper and lower regions of the product stack experience less radiation backscatter, the density discontinuity at these regions may be reduced or eliminated by placing reusable end-caps of substantial density onto the turntable and top of the product stack as required, thereby increasing back-scatter at these regions.

Referring now to FIG. 4, which illustrates an embodiment of the present invention, a radiation source (100) provides an initial radiation beam (40) of an intensity and energy useful for radiation processing of a product. The radiation source may be a radioactive isotope, electron beam, or X-ray beam source. Preferably, the source is an X-ray source produced from an electron beam (see FIGS. 5 and 6). The radiation beam passes through the aperture (generally indicated as 170) of an adjustable collimator (110) to shape the initial radiation beam (40) produced by the radiation source (100) into a collimated radiation beam (50). The aperture of the collimator can be adjusted to produce a collimated radiation beam of optimal geometry for radiation processing a product stack (60) of known size and density. The distance between the product stack and the source, collimator, or both source and collimator (e.g. L and S; FIG. 3) may also be adjusted as required to optimize the A/r ratio, and hence the DUR, for a given product.

The product stack (60) rotates on turn table (70) in the path of the collimated radiation beam (50). The product stack rotates at least once during the time interval of exposure to the radiation source. Preferably, the product stack rotates more than once during the exposure interval to smooth any variation of dose within the product arising from powering up or down of the accelerator. Detectors (180), and turn-table (70) are connected to the control system (120) so that the size of the aperture (170) of the adjustable collimator (110), the power (intensity) of the initial radiation beam (40), the speed of rotation of turntable (70), the distance of the turntable from the source (L+S), collimator (S), or a combination thereof, may be determined and adjusted, as required, either before or during radiation exposure of the product stack (60).

The embodiment described may also be used to irradiate product stacks (60) of known dimensions and densities and achieve a relatively low DUR within the product. As one skilled in the art would appreciate, the radiation dose being delivered to the product may be varied as required to account for changes in the distance of the product to the source, width of the rotating product, and density of product. For example, but not to be considered limiting, control system (120) may comprise a timer which dynamically regulates the aperture (170) of adjustable collimator (110) to produce a collimated radiation beam of controlled width (A), to account for changes in the width (r) of rotating product stack (60). The beam power of radiation source (100) may also be modulated as a function of the rotation of turn-table (70; as detected by angular position detector 230). In such a case, for example, but which is not to be considered limiting, a rectangular product stack of known dimension may be aligned on turn-table (70) in a particular orientation (detected by 230) such that as turn-table (70) rotates through positions which bring the corners of the product stack closer to radiation source (100) the radiation beam may be modified. Such modification may include dynamically adjusting the collimator (110) to modulate the dimension (e.g. A) of the collimated radiation beam (50), adjusting the width of the beam diameter, for example by adjusting the width of the scanning pattern, adjusting the distance between the product stack and source, or collimator, thereby modifying the relative beam dimension (A) and energy level with respect to the product stack, or placing or positioning an auxiliary shield (300) between the converter and product in order to adjust penumbra, and to shield and reduce the central dose of the radiation beam within the product. The control system may also regulate the energy and power of the initial radiation beam. Alternatively, control system (120) may regulate the rotation velocity of the turn-table as it rotates thereby allowing the corners of the product stack to be irradiated for a period of time that is different than that of the rest of the product stack. It is also contemplated that the control system may dynamically regulate any one, or all, of the parameters described above.

Referring now to FIG. 5, which illustrates another embodiment of the invention, wherein radiation source (100) is a source of X-rays produced from converter (30). Electrons (10) from an accelerator (20) interact with a converter (30) to generate X-rays (45). The X-ray beam (45) is shaped by aperture (170) of adjustable collimator (110) into a collimated X-ray beam (50) of optimal geometry for irradiation of the product stack (60) which rests on turn-table (70). Again, control system 120 monitors and, optionally, controls several components of the apparatus, including the rotation of turn-table (70), aperture of the collimator (110), power of the electron beam produced by accelerator (20), distance between turntable and the collimator (L), or a combination thereof.

During radiation processing, product stack (60) rotates about its vertical axis and intercepts a vertical collimated radiation beam (50). The product rotates at least once during the time exposed to radiation. In most, but not all instances, the width (A; FIG. 3) of the collimated beam is relatively narrow compared to the width of the product stack (r). Since the vertical plane of the collimated beam (50) is aimed at the centre of the rotating product stack (60), the periphery of the product stack is intermittently exposed to the radiation beam. This arrangement compensates for the relatively slow dose build-up at the centre of the product stack due to attenuation of X-rays by the materials of the product stack and produces a low DUR. With increased product density, for example but not limited to food such as meat, a narrower collimated beam width will be required in order to obtain a low DUR. Conversely, if a product is of a lower density (for example, medical supplies or waste) the beam width may be increased, or the radiation beam offset from the axis of rotation of the product stack, since the central portion of the product stack will receive its minimum dose more readily than that of a product stack of higher density.

In the embodiment shown in FIG. 5, the control system (120) is capable of modulating any or all of the irradiation parameters as outlined above. In certain cases however, such as irradiation of cylindrical product stacks of uniform and relatively low densities, for example serialization medical products, or it may be advantageous to irradiate the product stack with a radiation beam having a width approaching or approximately equal to the width of the product stack. The adjustable collimator of the proposed invention effectively allows this to be accomplished. By controlling the processing parameters this basic principle permits a relatively uniform radiation dose distribution and thus a low DUR to be delivered throughout the product stack for a large range of product size, shape and densities.

The converter (30) may comprise any substance which is capable of generating X-rays following collision with high energy electrons as would be known to one of skill in the art. The converter is comprised of, but not limited to, high atomic number metals such as, but not limited to, tungsten, tantalum or stainless steel. The interaction of high energy electrons with converter 30, produces X-rays and heat. Due to the large amount of heat generated in the converter material during bombardment by electrons, the converter needs to be cooled with any suitable cooling system capable of dissipating heat. For example, but not wishing to be limiting, the cooling system may comprise one or more channels providing for circulation of a suitable heat-dissipating liquid, for example water, however, other liquids or cooling systems may be employed as would be known within the art. The use of water or other coolants may attenuate X-rays, and therefore the cooling system needs to be taken into account when determining the energy level of the X-ray beam. As indicated above, attenuation of X-rays within the converter affects the energy spectrum of X-rays escaping from the converter. Therefore, adjustments to coolant flow, or the number of channels used for coolant travel within the converter may also contribute to altering the characteristics of the energy of the X-ray beam, providing a threshold cooling of the converter is achieved. For example, which is not to be considered limiting, a tantalum converter of about 1 to about 5 mm thickness, with a cooling channel covering the downstream side of the converter, may be used to generate the bremsstrahlung energy spectrum for product irradiation as described herein. The cooling channel may comprise, but is not limited to two layers of aluminum, defining a channel for coolant flow.

FIG. 6 illustrates another embodiment of the present invention, where electrons (10) from an accelerator (20) interact with a converter (30) to generate X-rays (45). The X-rays (45) are shaped by aperture (170) of adjustable collimator (110) into an X-ray beam (50) of optimal geometry for irradiation of a product stack. Transmitted X-Rays (140) passing through product stack (60) are detected by one or more detector units (180). Detection system (130) is connected with detector units (180) and other detectors that obtain data from other components of the apparatus including turntable rotation velocity (70) and angular position (230), distance between turntable and collimator (L), accelerator power (20), collimator aperture width (170), conveyor position (240), via interface 200 and 210. The detection system (130) also interfaces with control system (120; FIG. 7) which also comprises a computer (190) capable of processing the incoming data obtained from the detectors, and sending out instructions to each of the identified components to modify their configuration as required.

Detector units (180) may comprise one or more radiation detectors for example, but not limited to, ion chambers placed on the opposite side of the product stack (60) with respect to the incident radiation beam (50). As the product stack turns through the radiation beam (50) the detector units (180) register the transmitted radiation dose rate. The difference between incident and exiting radiation dose, and its variation along the stack height is related to the energy absorbing characteristics of the product stack as a function of several parameters for example, energy of the radiation beam, distance between the turntable (product) and the collimator (L), as a function of the product stack's angular position. The difference can thus be directly related to the density and geometry of the product stack.

A schematic representation of the control system (120) as described above is show in FIG. 7. The control system (120) comprises a computer capable of receiving input data, for example the required minimum radiation dose for a product (190), and data from components of the detection system (180) comprising the accelerator (20), turntable speed of rotation (70), angular position (230), distance to collimator (220), collimator aperture (170), and conveyors (240). The control system also establishes settings for, and sends the appropriate instruction to, each of these parameters to optimizes properties of the radiation beam relative to the product and produce a low DUR. Those of skill in the art will understand that variations of the control system may be possible without departing from the spirit of the current invention.

The embodiment outlined in FIG. 6 permits real-time monitoring of radiation processing of a product stack, and for real time adjustment between radiation processing of product stacks that differ in size, density or both size and density, so that an optimal radiation dose is delivered to each product stack to produce a low DUR. Adjustments to the parameters of the apparatus described herein may be made based on information obtained from a diagnostic scan. An optimized radiation exposure may be determined by calculating the difference between the transmitted radiation detected by detector units (180) and the incident radiation at the surface of the product stack closest to the radiation source (this value can be calculated or determined via appropriately placed detectors), as a function of the rotation of the product stack. In this way, the radiation dose of any product stack may be "fine-tuned" to deliver a requisite radiation dose to achieve a low DUR within a product stack.

The inclusion of a radiation detection system (130) also permits a diagnostic scan of the product stack (60) to determined the irradiation parameters required to deliver a relatively even radiation dose distribution (low DUR) in a product stack. The diagnostic scan characterizes the product stack (60) in terms of its geometry and apparent density before any significant radiation dose is accumulated in the product stack. As suggested in previous embodiments described herein, the diagnostic scan is not required for products of uniform density and stack geometry. The diagnostic scan may be carried out during the first turn of the product stack (60), or the diagnostic scan may be performed during multiple rotations of the product stack.

Those skilled in the art would understand that in order to irradiate a product stack to obtained a low DUR, the radiation beam must be capable of penetrating at least to the midpoint of a product. Similarly, if the detection system of the current invention is employed to automatically set the parameters for radiation processing of the product stack, then the radiation must be capable of penetrating the product stack.

The control system (120) of the present embodiment is designed to simultaneously adjust any one or all the processing parameters of the apparatus as described herein, for example but not wishing to be limiting, the total radiation exposure time, the ratio of the radiation beam width to the principal horizontal dimension of the product stack, in relation to the angular position ($\phi$) of the X-ray beam (ratio of $A(\phi)/r(\phi)$), the power of the radiation beam, the rotational velocity of the turn-table, and the distance between the product and collimator. The control system may adjust the processing parameters based on the total radiation dose required within the product as input by an operator, or the radiation dose may be automatically set at a predetermined value. For example, but not wishing to be limiting, if it is known that a certain base radiation dose is required for a given product stack, for example the treatment of a food product, then this dose may be preset, and the operating conditions monitored to achieve a low DUR for this dose. However, if two product stacks are of different dimensions or different densities then dissimilar irradiation parameters may be required to deliver the predetermined total radiation dose with an optimal DUR to each stack.

Figure 8:
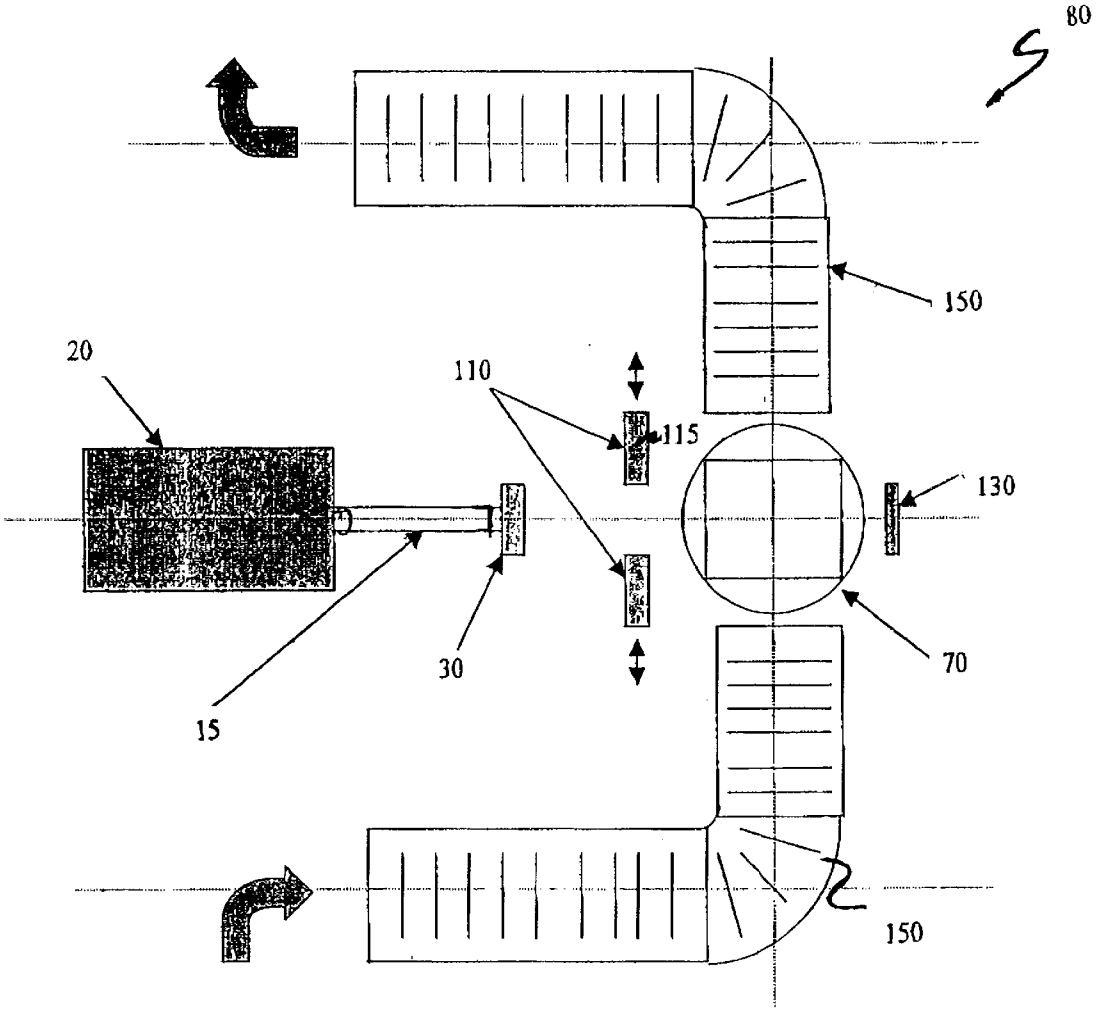
FIG. 8 illustrates an aspect of an embodiment of the current invention displaying a conveyor system integrated with the radiation processing system described wherein for delivery and removal of product stacks.

As shown in FIG. 8, the apparatus of the present invention may be placed within a conveyor system to provide for the loading and unloading of product stacks (60) onto turntable 70. A conveyor (150) delivers and takes away product stacks, for example but not limited to, palletized product stacks or totes, to and from the turntable (70). In the embodiment shown, the collimated radiation beam is produced from a converter (30) that is being bombarded with electrons produced by accelerator 20, and travelling through a scanning form (25). However, it is to be understood that the source may also be a radioactive isotope as previously described. Not show in FIG. 8 are components of the detection or control systems.

Products to be processed using the apparatus and method of the present invention may comprise foodstuffs, medical articles, medical waste or any other product in which radiation treatment may promote a beneficial result. The product stack may comprise materials in any density range that can be penetrated by a radiation beam. Preferably products have a density from about 0.1 to about 1.0 g/cm$^3$. More preferably, the range is from about 0.2 to about 0.8 g/cm$^3$. Also, the product stack may comprise but is not necessarily limited to a standard transportation pallet, normally having dimensions 42×48×60 inches. However any other sized or shaped product, or product stack may also be used.

The present invention may use any suitable radiation source, preferably a source that produces X-rays. The electron beam may be produced using an RF (radio frequency) accelerator, for example a "Rhodotron" (Ion Beam Applications (IBA) of Belgium), "Impela" (Atomic Energy of Canada), or a DC accelerator, for example, "Dynamitron" (Radiation Dynamics), also the radiation source may produce X-rays, for example which is not to be considered limiting, through the ignition of an electron cyclotron resonance plasma inside a dielectric spherical vacuum chamber filled with a heavy weight, non-reactive gas or gas mixture at low pressure, in which conventional microwave energy is used to ignite the plasma and create a hot electron ring, the electrons of which bombard the heavy gas and dielectric material to create X-ray emission (U.S. Pat. No. 5,461,656). Alternatively, the radiation source may comprise a gas heated by microwave energy to form a plasma, followed by creating of an annular hot-electron plasma confined in a magnetic mirror which consists of two circular electromagnet coils centered on a single axis as is disclosed in U.S. Pat. No. 5,838,760. Continuous emission of bremsstrahlung (X-rays) results from collisions between the highly energetic electrons in the annulus and the background plasma ions and fill gas atoms.

It is also contemplated in the present invention that the radiation source may comprise a gamma source. Since gamma sources comprising high energy radionucleotides such as cobalt-60 emit radiation in multiple directions, one or more of the systems described herein may be positioned around the gamma source, permitting the simultaneous radiation processing of plurality of products. Each system would comprise an adjustable collimator (110), turntable (70), detection system (130), a means for loading and unloading the turntable (e.g. 150), and be individually monitored so that each product stack receives an optimal radiation dose with a low DUR. In this latter embodiment, one control system (120) may monitor and control the individual components of each system, or the control systems may be used individually.

The above description is not intended to limit the claimed invention in any manner, furthermore, the discussed combination of features might not be absolutely necessary for the inventive solution.

The present invention will be further illustrated in the following examples. However it is to be understood that these examples are for illustrative purposes only, and should not be used to limit the scope of the present invention in any manner.

EXAMPLES

Example 1

Radiation Profiles in a Product with Densities of about 0.2 or about 0.8 g/cm$^3$ An accelerator capable of producing an electron beam of 200 Kw is used to generate X-rays from a tungsten, water cooled converter. The bremsstrahlung energy spectrum of the X-ray beam produced in this manner extends from 0 to about 5 MeV, with a mean energy of about 0.715 MeV. A cylindrical product stack of 120 cm diameter, comprising a product with an average density of either 0.2 or 0.8 g/cm$^3$ is placed onto a turntable that rotates at least once during the duration of exposure to the radiation beam. The distance from the source plane (converter) to the center to the product stack is 112 cm. The collimator is set to produce a beam width of 10, 50 or 120 cm. The rectangular cross section of height of the beam is set to the height of the product stack. Typically a product stack characterised in having a density of 0.2 g/cm$^3$ is exposed to radiation for about 2 to about 2.5 min, while a product having an average density of 0.8 g./cm$^3$ is exposed for about 10 min in order to achieve the desired $D_{min}$.

Figure 9:
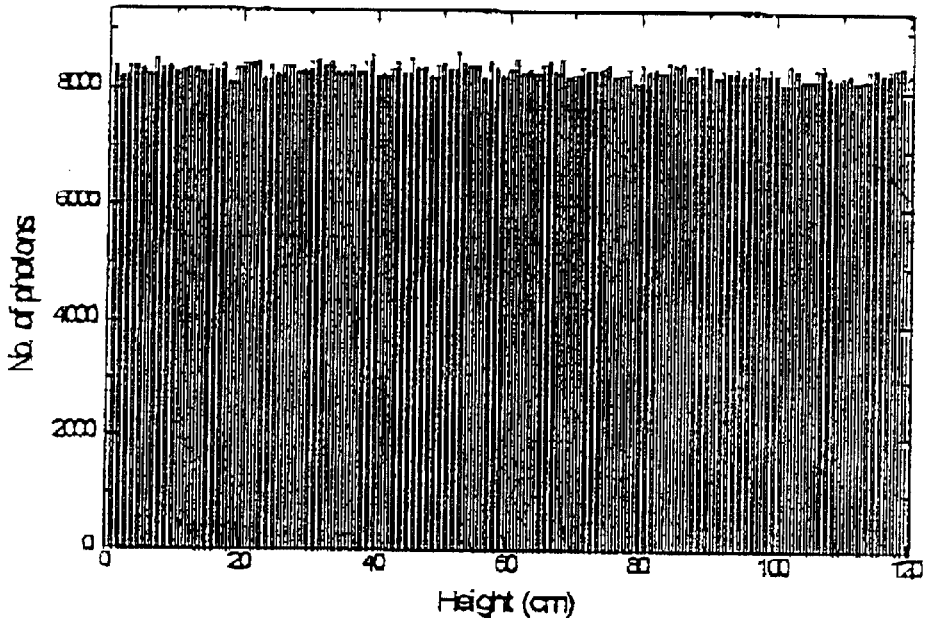
FIG. 9 shows uniformity of bremsstrahlung energy (as indicated by the number of photons) over the height of a product stack.

The photon output over the height of the beam was determined for each aperture width, and is constant in both a horizontal and vertical dimension (FIG. 9). Depth dose profiles are determined for three aperture widths, 10, 50 and 120 cm, for a 5 MeV endpoint bremstrahlung x-ray spectrum, with a mean energy of about 0.715 MeV, for each product average density. The results are presented in FIGS. 10(*a*) and (*b*)), and Tables 1 and 2.

TABLE 1

Figure 10A:
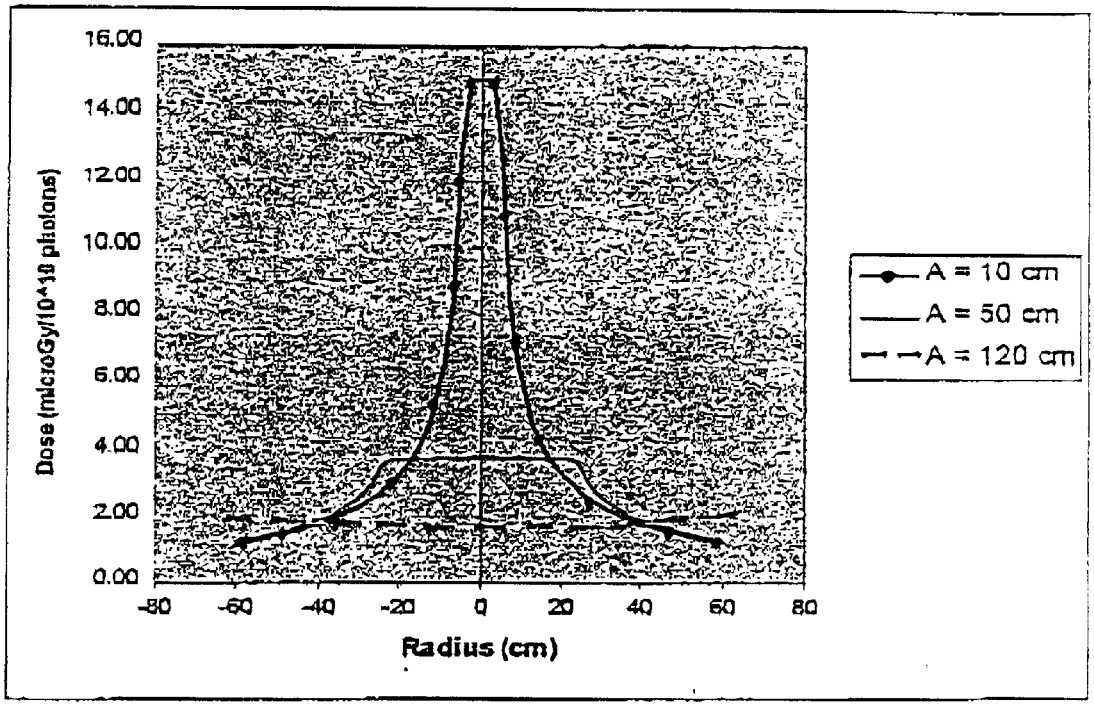
FIG. 10 shows the dose depth profile for products rotating on a turntable and exposed to X-ray radiation.

Results for a 0.2 g/cm$^3$ product stack (see FIG. 10(a))

| Aperture (cm) | $Dose_{Max}$:$Dose_{Min}$ | Beam use efficiency (%) |
|---|---|---|
| 10 | 12.6 | 49.5 |
| 50 | 3.1 | 48.5 |
| 120 | 1.14 | 41.7 |

TABLE 2

Figure 10B:
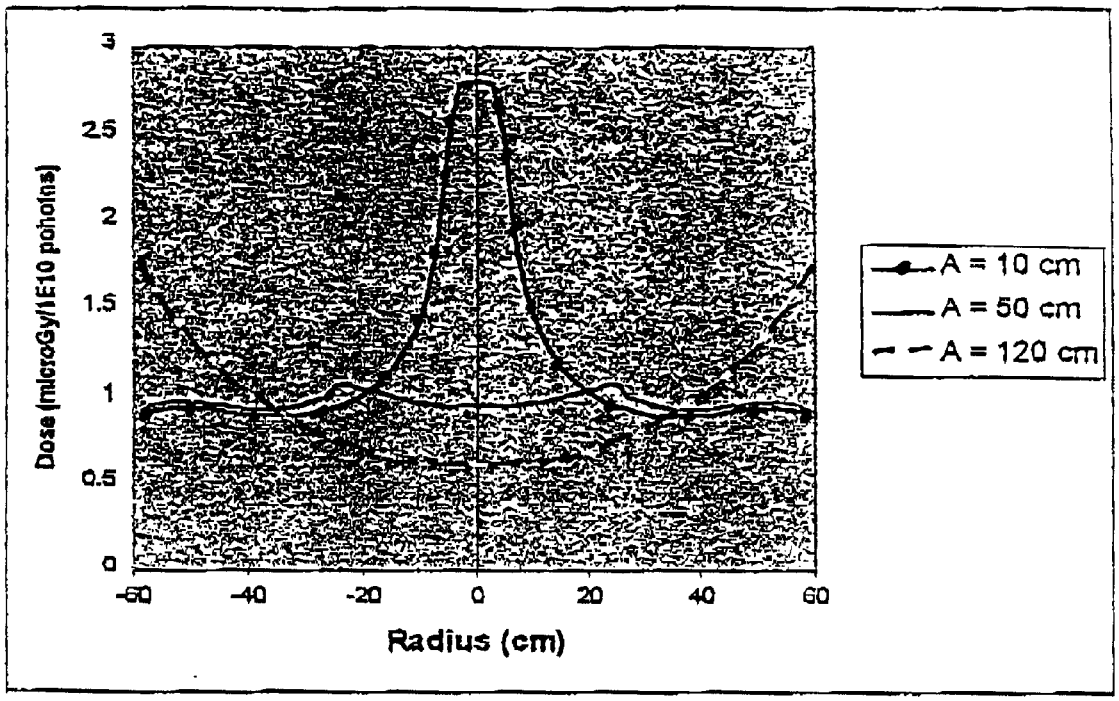

Results for a 0.8 g/cm$^3$ product stack (see FIG. 10(b))

| Aperture (cm) | $Dose_{Max}$:$Dose_{Min}$ | Beam use efficiency (%) |
|---|---|---|
| 10 | 3.1 | 88.3 |
| 50 | 1.16 | 87.8 |
| 120 | 3.1 | 81.4 |

Example 2

Irradiation of Circular and Rectangular Products: 1 mm Convertor

Bremsstrahlung X-rays are produced as described above using a 5 MeV electron beam with a circular cross section (10 mm diameter) that scanner vertically across the converter. A 1 mm Ta converter backed with an aluminum (0.5 cm) water (1 cm) aluminum (0.5 cm) cooling channel is used to generate the X-rays. A product of 0.8 g./cm$^3$, with two footprints are tested: one involved a cylindrical product with a 60 cm or 80 cm radius footprint, the other is a rectangular product with a footprint of 100 X 120 cm, and 180 cm height, both product geometries are rotated at least once during the exposure time. The distance from the converter to the collimator is 32 cm.

In order to optimize DUR, several collimator apertures were tested for a cylindrical product (Table 3). Examples of several determinations of the dose along a slice of the product, for a 60 cm radius cylindrical product stack are presented in FIG. 11. Table 3: DUR determination for cylindrical products (0.8 g/cm$^3$ density), of varying diameter (r), for a range of collimator aperture widths (A) using a 1 cm electron beam producing bremsstrahlung X-rays from a 1 mm Ta converter.

| | $D_{max}$:$D_{min}$ | | |
|---|---|---|---|
| Aperture, 'A' (cm) | r = 60 | r = 70 | r – 80 |
| 8 | 1.63 | 1.61 | 1.72 |
| 10 | 1.41 | 1.38 | 1.12 |
| 11 | 1.13 | nd* | 1.76 |
| 13 | 1.19 | nd | nd |
| 15 | 1.14 | 1.38 | nd |
| 20 | 1.38 | 1.63 | 2.02 |

*not determined

Figure 11A:
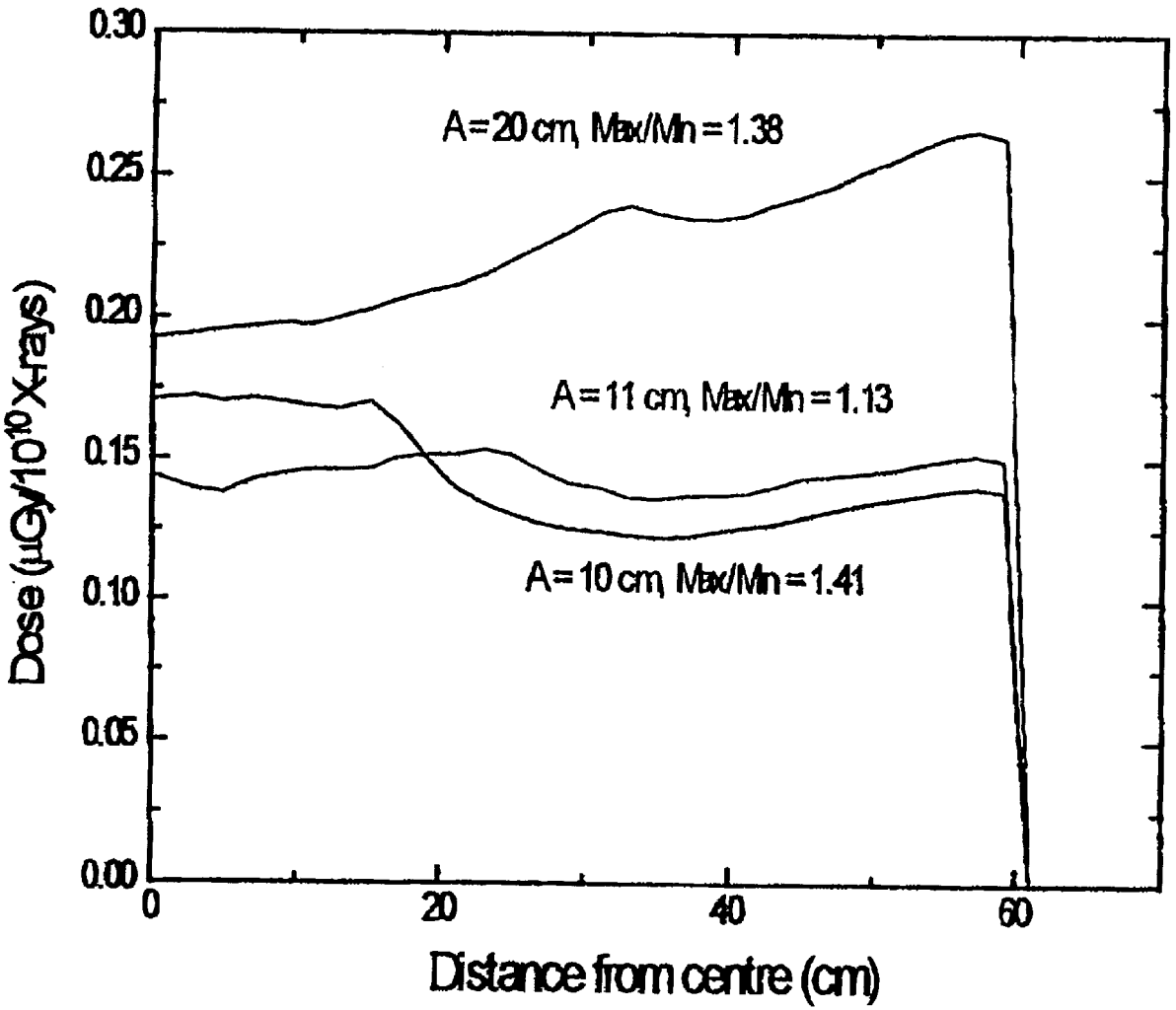
FIG. 11 shows the dose depth profile for products rotating on a turntable and exposed to X-ray radiation for a product with a density of 0.8 g./cm$^3$, for three collimator aperture widths of, 10, 11 and 20 cm.
Figure 11B:
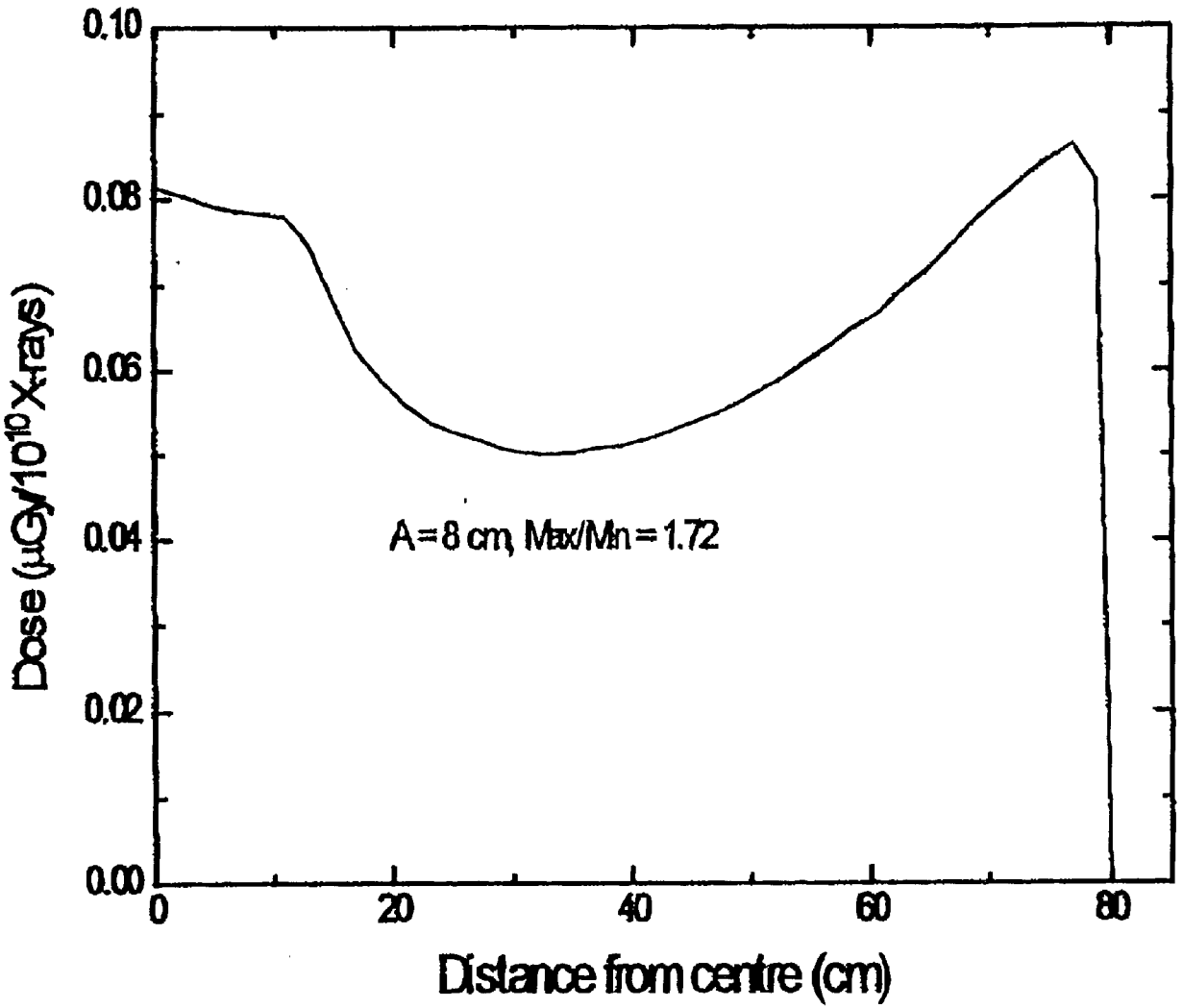
Figure 11C:
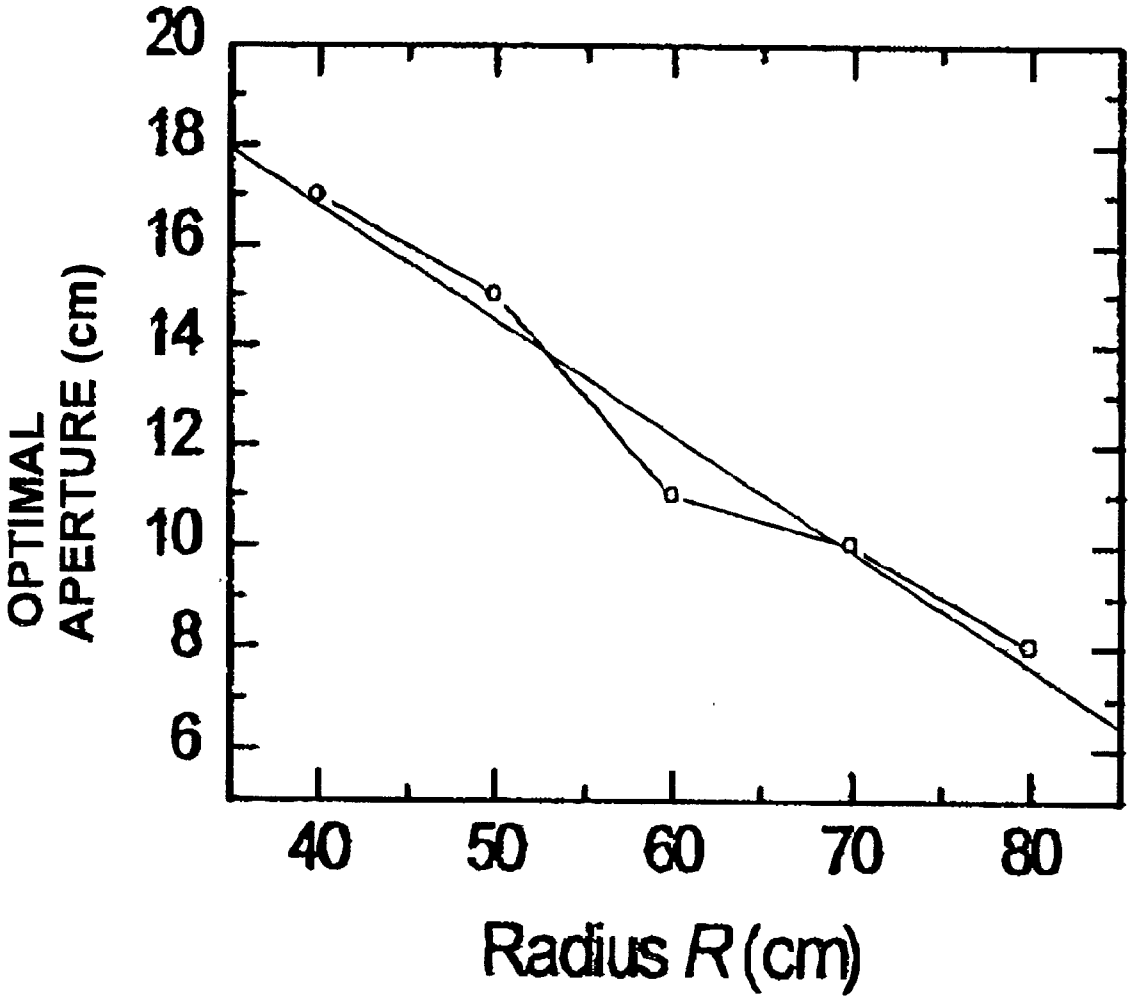

In each tested product diameter, the DUR varied as the collimator aperture changed. Typically, for smaller and larger aperture the DUR was higher when compared with the optimal aperture width. For example, a product of 60 cm diameter exhibited an optimal DUR with a collimator aperture of 11 cm. With this aperture width, the dose was generally uniform throughout the product stack (see FIG. 11(*a*)). With an increased width of collimator aperture, of 20 cm, the dose increased towards the periphery of the product, while with a smaller collimator aperture (10 cm), the central portion of the product received an increase dose (FIG. 11(*a*)). With a product of increased diameter (80 cm), the DUR increased, and exhibited a greater variation in dose received across the depth of the product (FIG. 11(*b*)). The general relationship between width of collimator aperture and product diameter, that produces an optimal DUR is shown in FIG. 11(*c*), where, for a cylindrical product, the lowest DUR is achieved using a narrower aperture with increasing product diameter.

Figure 12A:
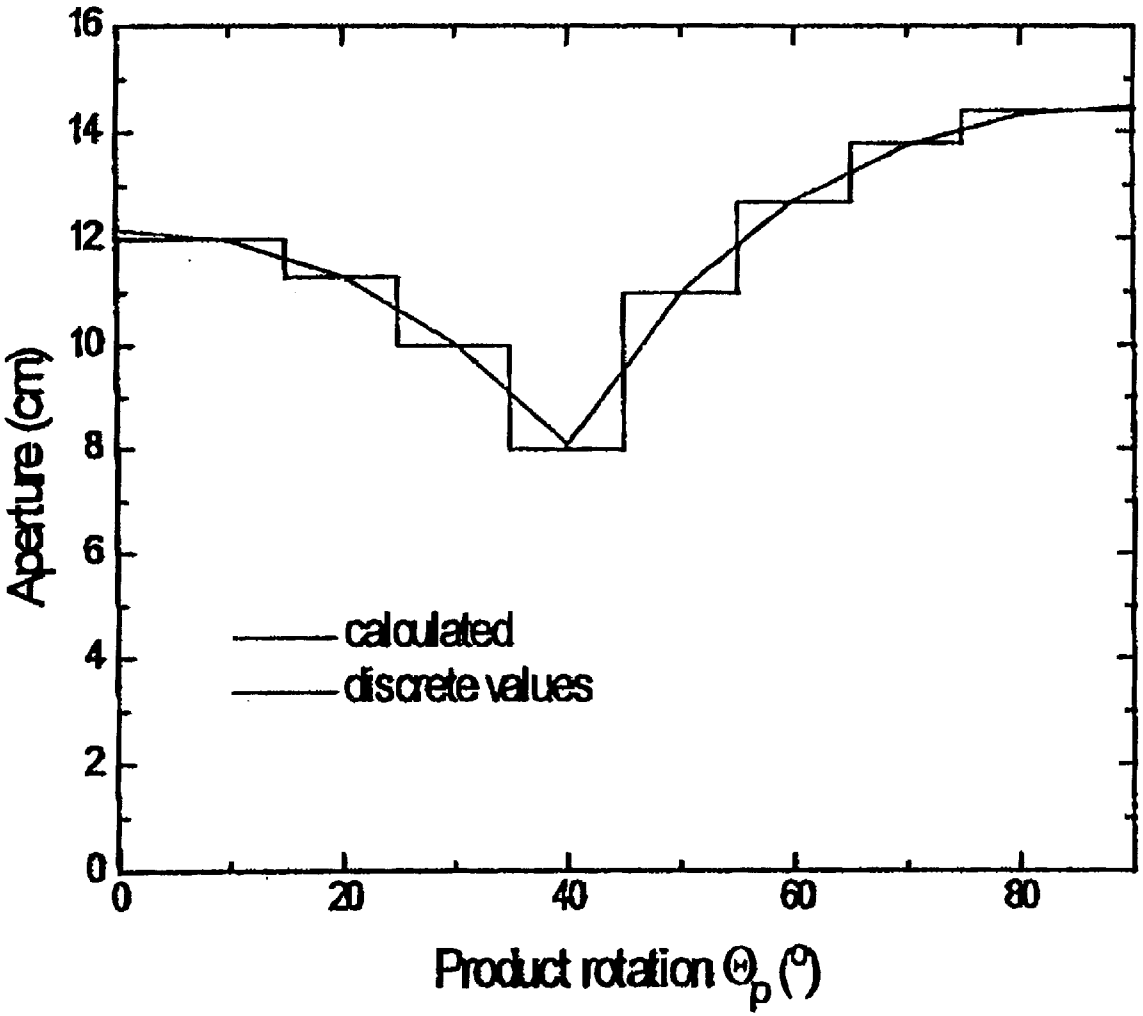
FIG. 12 shows one set of adjustments that may be made to collimator aperture width and radiation beam power during irradiation of a rotating rectangular product.
Figure 12B:
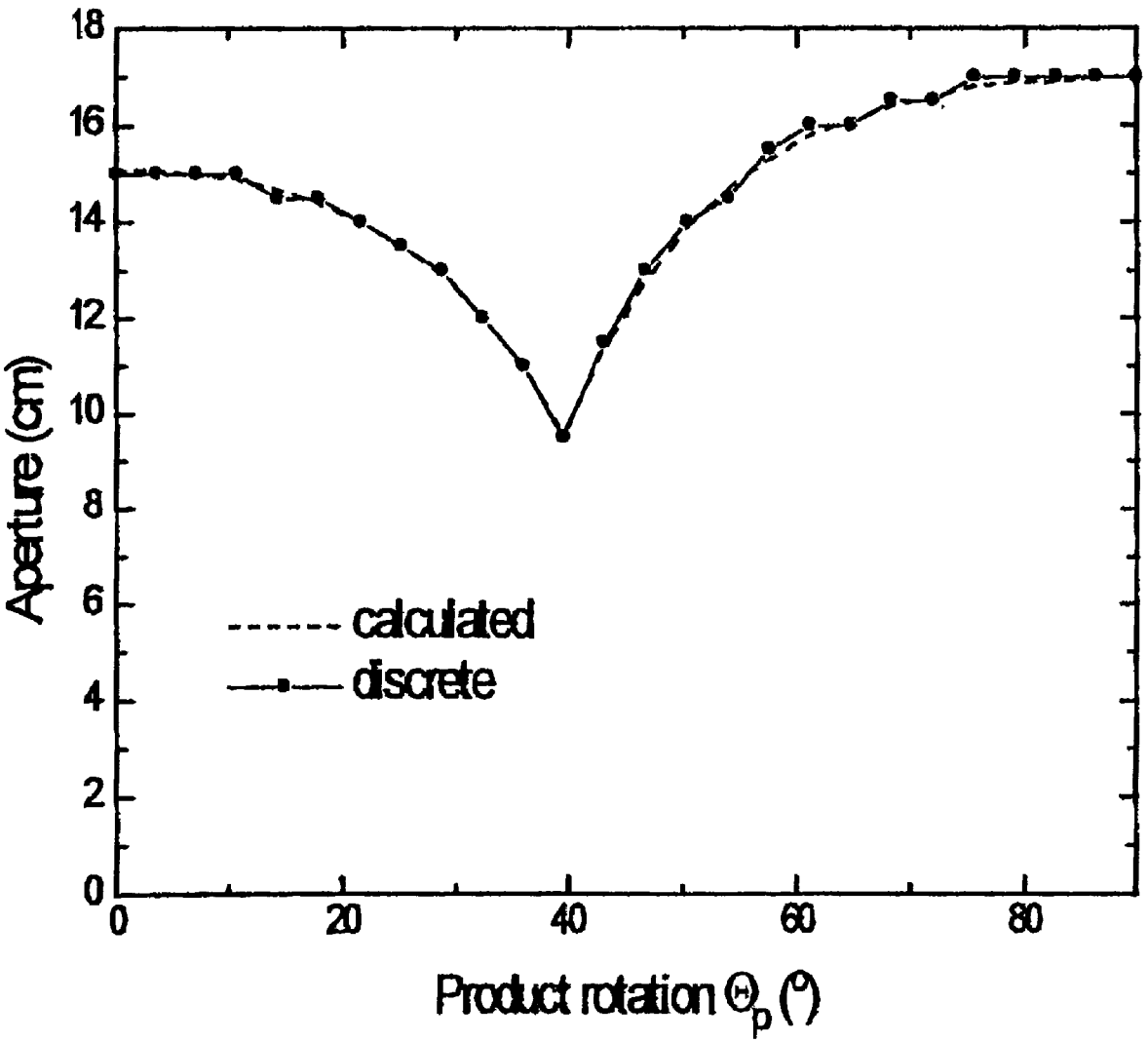
Figure 12C:
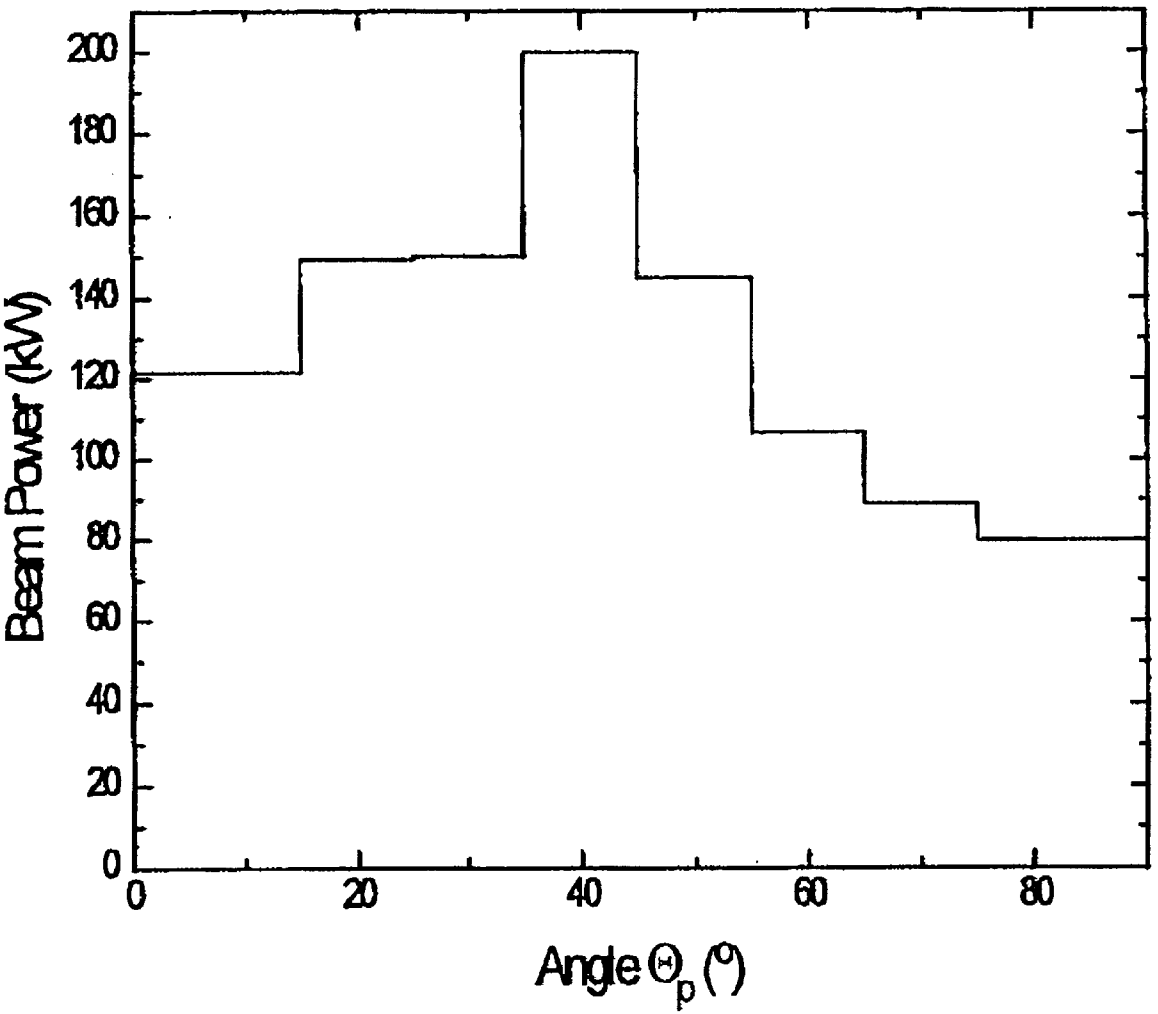
Figure 12:
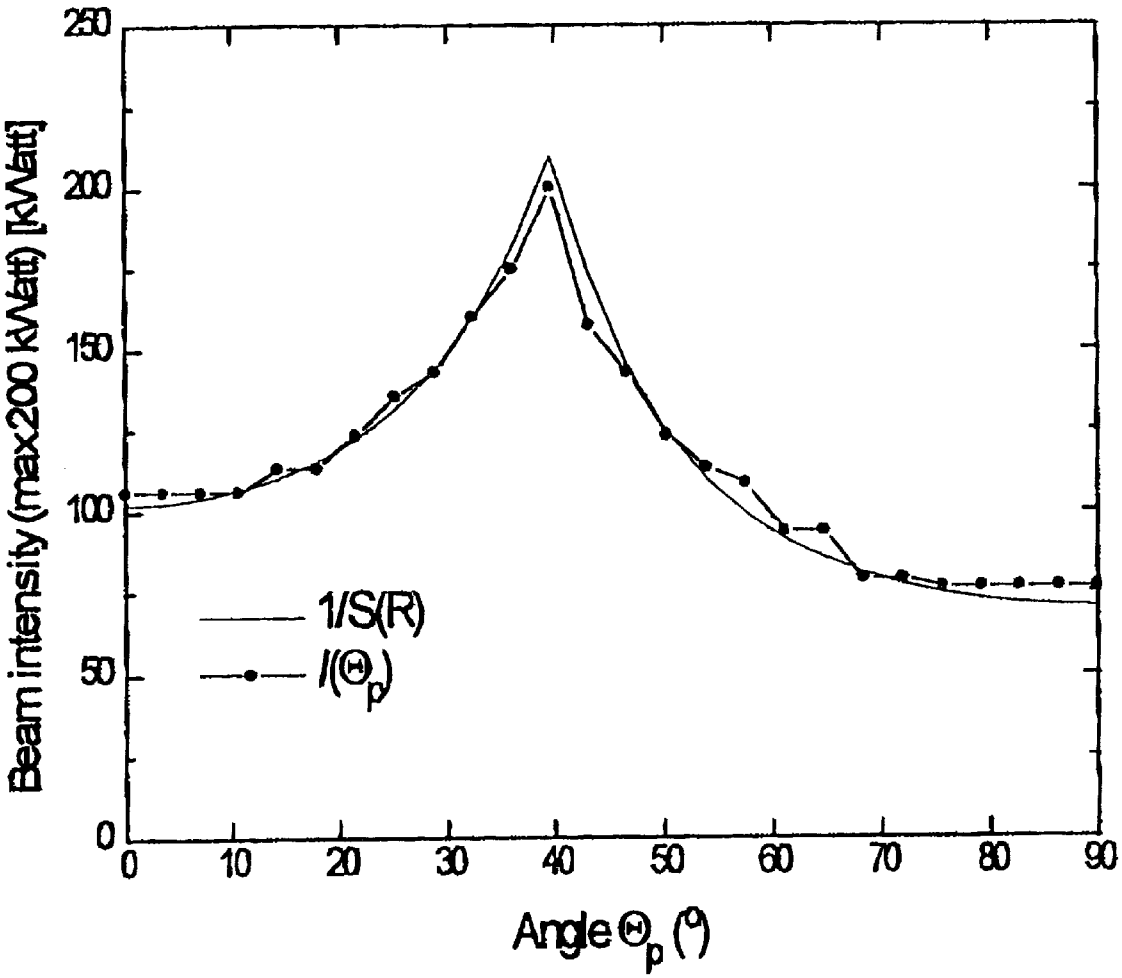

For a rectangular product footprint (120 cm X 100 cm), the apparent depth of the product, relative to the incident radiation beam, varies as the rectangular product rotates, relative to the beam. In order to optimize the DUR, the collimator aperture width, beam intensity (power), or both, may be dynamically adjusted in order to obtain the most optimal DUR. An example of adjusting aperture width during product rotation is shown in FIG. 12(*a*). In this example, 8 aperture width adjustment are made over 90° rotation of the product. These same aperture adjustments are repeated for the remaining 270° of product rotation so that 32 discrete aperture widths take place during one rotation of a rectangular product. However, it is to be understood that the number of discrete aperture widths may vary from the number shown in FIG. 12(*a*), and may include fewer, or more, adjustments as required. For example, for products of lower density, fewer or no adjustments may be required. Irradiation of a rectangular product using constant beam power, and adjusting only the aperture width during product rotation produces a DUR of 3.21.

An optimized DUR may also be obtained through adjustment of the intensity of the radiation beam during rotation of a rectangular product stack (FIG. 12(*c*)). In this example, 8 different beam power adjustments are made over 90° rotation of the product. The same beam power adjustments are repeated for the remaining 270° rotation of the product. Again, the number of adjustments of beam power, as a function of product rotation, may vary from that shown in order to optimize DUR, depending upon the size and configuration of the product stack, as well as density of the product itself. Irradiation of a rectangular product using a constant collimator aperture width, and adjusting the beam power produces a DUR of 1.96.

In order to further optimize the DUR, both the aperture and beam power may be modulated as the product rotates. When both parameters are modulated, a DUR of from 1.47 to 1.54 was obtained for irradiation of a 0.8 g./cm$^3$, rectangular product (footprint:120 cm X 100 cm), placed at 80 cm from the collimator aperture, using a 1 mm Ta converter (accelerator running a t 200 kW, 40 mA electron beam at 5 MeV).

Example 3

Irradiation of Circular and Rectangular Products: 2.35 mm Convertor

The $D_{max}$:$D_{min}$ ratio may still be further optimized by increasing the overall penetration of the beam within the product. This may be achieved by increasing the thickness of the convertor to produce a X-ray beam with increased average photon energy. In order to balance yield of X-rays and beam energy, a Ta convertor of 2.35 mm (including a cooling channel; 0.5 cm Al, 1 cm $H_2O$, 0.5 cm Al) was selected. This thicker convertor generates fewer photons per beam electron (0.329 photon/beam electron), compared with the 1 mm convertor (0.495 photon/beam electron) due to the increased thickness and attenuation of the X-ray beam. However, even though the number of X-rays produced is lower with a 2.35 mm convertor, the beam that exits the convertor is of a higher average photon energy. As a result of the change in irradiation beam properties, the effect of aperture width and beam power were examined within cylindrical and rectangular products as outlined in Example 2. Results for adjusting the collimator aperture width are presented in Table 4.

Table 4: DUR determination for cylindrical products (0.8 g/cm$^3$ density), of varying diameter (r), for a range of collimator aperture widths (A) using a 1 cm electron beam producing bremsstrahlung X-rays from a 2.35 mm Ta converter.

| Aperture, 'A' (cm) | $D_{max}$:$D_{min}$ r = 60 | r = 70 | r – 80 |
|---|---|---|---|
| 8 | nd* | 1.69 | 1.64 |
| 10 | 1.44 | 1.43 | 1.6 |
| 12 | 1.28 | 1.3 | 1.64 |
| 13 | | 1.32 | nd |
| 14 | 1.18 | 1.32 | nd |
| 15 | 1.14 | nd | nd |
| 20 | 1.28 | nd | nd |

*not determined

For the irradiation of a rectangular product (120 cm X 100 cm; 0.8 g./cm$_3$ density), the collimator aperture may be adjusted to account for changes in the apparent depth of the product relative to the incident radiation beam during product rotation (FIG. 12(*b*)). Irradiation of a rectangular product using constant beam power, and adjusting only the aperture width produces a DUR of 2.42.

As outlined in example 2, the power of the beam may also be adjusted during product rotation (FIG. 12(*d*)). Irradiation of a rectangular product using a constant aperture width, and adjusting the beam poser, produces a DUR of 1.72.

By adjusting both collimator aperture width and beam power during product rotation, a DUR of from 1.27 to 1.32 is achieved.

All publications are herein incorporated by reference.

The present invention has been described with regard to preferred embodiments. However, it will be obvious to persons skilled in the art that a number of variations and modifications can be made without departing from the scope of the invention as described herein.

The embodiments of the invention in which an exclusive property of privilege is claimed are defined as follows:

1. A product irradiator comprising: a radiation source, an adjustable collimator, a turntable, a control system and a detection system, wherein said collimator comprises one or more radiation opaque shielding elements, and said detection system measures at least one the following parameters: transmitted radiation, instantaneous angular velocity of said turntable, angular orientation of said turntable, power of a radiation beam produced by said radiation source, energy of said radiation beam, width of said radiation beam, collimator aperture, position of an auxiliary shield, offset of said radiation beam from the axis of rotation of said turntable, distance of said turntable from collimator, distance of said collimator from said radiation source.

2. The product irradiator of claim 1 wherein said detection system is operatively linked with said control system.

3. A method of radiation processing a product comprising:

i) placing said product onto a turntable and establishing at least one of the following properties: length, width, height, density, and density distribution of said product;

ii) determining width for a collimated radiation beam required to produce a Dose Uniformity Ratio of from about 1 to about 2, within said product;

iii) adjusting at least one of the following parameters in phase with turntable rotation: collimator aperture, distance between said turntable and collimator, and turntable offset, to obtain said width of a collimated radiation beam determined in step ii), wherein said width of said collimator aperture is adjusted as a function of angular orientation of said turntable;

iv) producing a collimated radiation beam using a collimator comprising one or more radiation opaque shielding elements; and v) rotating said product within said collimated radiation beam for a period of time sufficient to achieve a minimum required radiation dose within said product.

4. A method of radiation processing a product comprising:

i) placing said product onto a turntable and establishing at least one of the following properties: length, width, height, density, and density distribution of said product;

ii) determining width for a collimated radiation beam required to produce a Dose Uniformity Ratio of from about 1 to about 2, within said product;

iii) adjusting at least one of the following parameters in phase with turntable rotation: collimator aperture, distance between said turntable and collimator, and turntable offset, to obtain said width of a collimated radiation beam determined in step ii), wherein an angular velocity of said turntable is a parameter that may be adjusted, and wherein said collimated radiation beam is a collimated X-ray beam produced from high energy electrons generated by an electron accelerator, and power of said high energy electrons is adjusted; iv) producing a collimated radiation beam using a collimator comprising one or more radiation opaque shielding elements;

v) rotating said product within said collimated radiation beam for a period of time sufficient to achieve a minimum required radiation dose within said product; and vi) detecting X-rays transmitted through said product.

5. The method of claim 4, wherein during or following said step of detecting, is:

i) processing information obtained in said detecting step by a control system and altering, if required, of any of the following parameters: collimator aperture, distance between said turntable and collimator, turntable offset, position of auxiliary shield, angular velocity of said turntable, power of said high energy electrons.

6. A product irradiator comprising:

i) an X-ray radiation source essentially consisting of an electron accelerator for producing high energy electrons, a scanning horn by directing said high energy electrons towards a convertor, said converter for converting said high energy electrons into X-rays to produce an X-ray beam, said X-ray beam directed towards a product requiring irradiation;

ii) an adjustable collimator comprising one or more radiation opaque shielding element for shaping said X-ray beam;

iii) a turntable upon which said product is placed, wherein said turntable may be movable towards or away from said adjustable collimator, or said turntable may be movable laterally, so that an axis of rotation of said product on said turntable is offset from axis of said X-ray beam;

v) a detection system in operative association with said control system.

7. The product irradiator of claim 6, further comprising an auxiliary shield.

8. The product irradiator of claim 7, wherein said detection system measures at least one of the following parameters: transmitted X-ray radiation, instantaneous angular velocity of said turntable, angular orientation of said turntable, power of said high energy electrons, width of high energy electron beam, energy of said X-ray beam, aperture of said adjustable collimator, position of said auxiliary shield, offset of said radiation beam from axis of rotation of said turntable, distance of said turntable from collimator, and distance of said collimator from said radiation source.

* * * * *

UNITED STATES PATENT AND TRADEMARK OFFICE

CERTIFICATE OF CORRECTION

PATENT NO. : 6,504,898 B1 
DATED : January 7, 2003
INVENTOR(S) : Jiri Kotler and Joseph Borsa It is certified that error appears in the above-identified patent and that said Letters Patent is hereby corrected as shown below:

Title page,
Item [57], ABSTRACT,
Line 3, change "(DUR)" to -- (DUR)) --

Column 1,
Line 28, delete "achieved" replace with "receive"

Column 2,
Line 4, delete "suggest" replace with -- suggests --.

Column 4,
Line 14, delete "beam is" insert -- a --.
Line 19, delete "(step vi)" replace with -- (step v) --.

Column 6,
Line 55, delete "2702" replace with -- 270° --.

Column 11,
Line 35, delete "Y-radiation" replace with -- γ-radiation --.
Line 41, delete "Y" replace with -- γ --.
Line 47, after "aperture" delete "(W)".
Line 62, after "uniformity" insert -- ratio --.
Line 63, after "adjusted" insert -- to --.

UNITED STATES PATENT AND TRADEMARK OFFICE

CERTIFICATE OF CORRECTION

PATENT NO. : 6,504,898 B1 
DATED : January 7, 2003
INVENTOR(S) : Jiri Kotler and Joseph Borsa It is certified that error appears in the above-identified patent and that said Letters Patent is hereby corrected as shown below:

Column 18,
Line 27, delete “scanner” replace with -- scan --.
Line 41, after “FIG. 11.” begin new paragraph being with --Table 3: --

Signed and Sealed this

Twenty-third Day of September, 2003

JAMES E. ROGAN
*Director of the United States Patent and Trademark Office*